US011059613B2

(12) United States Patent
Yokoo

(10) Patent No.: US 11,059,613 B2
(45) Date of Patent: Jul. 13, 2021

(54) SHEET STORAGE APPARATUS

(71) Applicant: GLORY LTD., Hyogo (JP)

(72) Inventor: Tomohiro Yokoo, Hyogo (JP)

(73) Assignee: GLORY LTD., Hyogo (JP)

( * ) Notice: Subject to any disclaimer, the term of this patent is extended or adjusted under 35 U.S.C. 154(b) by 185 days.

(21) Appl. No.: 16/395,671

(22) Filed: Apr. 26, 2019

(65) Prior Publication Data

US 2019/0330005 A1 Oct. 31, 2019

(30) Foreign Application Priority Data

Apr. 27, 2018 (JP) ..... JP2018-086334

(51) Int. Cl.

| | |
|---|---|
| ***B65B 25/14*** | (2006.01) |
| ***B65H 31/00*** | (2006.01) |
| ***B65H 31/02*** | (2006.01) |
| *B65B 35/50* | (2006.01) |
| *B65B 5/10* | (2006.01) |

(52) U.S. Cl.

CPC ..... *B65B 25/14* (2013.01); *B65H 31/00* (2013.01); *B65H 31/02* (2013.01); *B65B 5/106* (2013.01); *B65B 35/50* (2013.01); *B65H 2301/4212* (2013.01); *B65H 2301/422548* (2013.01); *B65H 2701/1912* (2013.01)

(58) Field of Classification Search

CPC ..... B65H 31/34; B65H 31/38; B65H 31/40; B65H 2405/1142; B65H 2405/11425; B65H 2405/1144; B65H 31/00; G07D 11/17; B65B 5/106; B65B 51/146; B65B 5/067; B65B 43/54; B65B 25/14; B65B 7/02; B65B 35/40

See application file for complete search history.

(56) References Cited

U.S. PATENT DOCUMENTS 9,129,463 B2 * 9/2015 Langhuber ..... B65B 25/14
9,452,853 B2 * 9/2016 Doll ..... B29C 66/81421
(Continued)

FOREIGN PATENT DOCUMENTS

| | | |
|---|---|---|
| JP | 2008-171334 A | 7/2008 |
| KR | 2016-0087062 A | 7/2016 |
| WO | 2016/136517 A1 | 9/2016 |

OTHER PUBLICATIONS

European Search Report, European Patent Office, Application No. 19171134.0, dated Sep. 20, 2019, 7 pages.

*Primary Examiner* — Jeremy R Severson
(74) *Attorney, Agent, or Firm* — Greenblum & Bernstein, P.L.C.

(57) ABSTRACT

A sheet storage apparatus having: a holding section that holds a storage bag for storing a sheet; a first clamping section; and a second clamping section, wherein the first clamping section and the second clamping section relatively approach to clamp the storage bag held by the holding section, and when a direction in which the first clamping section relatively approaches the second clamping section is defined as a first direction, and a direction opposite to the first direction is defined as a second direction, an end of the first clamping section in the first direction is located on a side in the first direction with respect to an end of the second clamping section in the second direction in a state in which the storage bag is clamped between the first clamping section and the second clamping section.

11 Claims, 19 Drawing Sheets

(56) References Cited

U.S. PATENT DOCUMENTS

| | | | | |
|---|---|---|---|---|
| 9,466,167 | B2 * | 10/2016 | Razzaboni | B65B 5/067 |
| 10,046,873 | B2 * | 8/2018 | Razzaboni | G07D 11/125 |
| 10,169,944 | B2 * | 1/2019 | Razzaboni | B65B 7/02 |
| 2013/0213763 | A1 * | 8/2013 | Rao | G07D 11/12 194/350 |
| 2014/0254960 | A1 | 9/2014 | Tanaike et al. | |
| 2018/0029730 | A1 | 2/2018 | Yokoo et al. | |

* cited by examiner

SHEET STORAGE APPARATUS

CROSS REFERENCE TO RELATED APPLICATIONS

This application is entitled to (or claims) the benefit of Japanese Patent Application No. 2018-086334, filed on Apr. 27, 2018, the disclosure of which including the specification, drawings and abstract is incorporated herein by reference in its entirety.

TECHNICAL FIELD

The present invention relates to a sheet storage apparatus that stores a sheet in a bag.

BACKGROUND ART

Conventionally, a sheet storage apparatus that stores a sheet in a storage bag such as a pouch bag is used. For example, PTL 1 discloses a banknote storage apparatus that stores a banknote as one kind of sheets. The banknote storage apparatus disclosed in PTL 1 includes a pair of stage members. A storage bag is clamped between the pair of stage members, and the pair of stage members supports the banknote stored in the storage bag from a lower side. The storage of the banknote in the storage bag is completed, and then the banknote storage apparatus can close a bottom of the storage bag by heating members provided in the stage members.

CITATION LIST

Patent Literature

PTL 1
WO 2016/136517

SUMMARY OF INVENTION

Technical Problem

In the aforementioned banknote storage apparatus, when the banknote is obliquely stored in the storage bag, there is a possibility that the banknote falls from a space between the pair of stage members.

The present invention has been made in view of such circumstances, and an object of the present invention is to provide a sheet storage apparatus in which a banknote stored in a storage bag is prevented from falling from a space between stage members.

Solution to Problem

A sheet storage apparatus according to the present invention comprises: a holding section that holds a storage bag for storing a sheet; a first clamping section; and a second clamping section, wherein the first clamping section and the second clamping section relatively approach to clamp the storage bag held by the holding section, and when a direction in which the first clamping section relatively approaches the second clamping section is defined as a first direction, and a direction opposite to the first direction is defined as a second direction, an end of the first clamping section in the first direction is located on a side in the first direction with respect to an end of the second clamping section in the second direction in a state in which the storage bag is clamped between the first clamping section and the second clamping section.

Advantageous Effects of Invention

According to the present invention, a banknote stored in a storage bag can be prevented from falling from a space between a pair of stage members.

BRIEF DESCRIPTION OF DRAWINGS

FIG. 8 is a perspective view of a pantograph that moves the press-in plate, and the like;

FIG. 9 is a perspective view of a pantograph, a motor and a gear that operate the pantograph, and the like;

FIG. 10A is a rear view of a second cam mounted on a rotating shaft, and the like;

FIG. 10B is a rear view of the second cam mounted on the rotating shaft, and the like;

DESCRIPTION OF EMBODIMENTS

Hereinafter, a banknote storage apparatus that stores a banknote will be described as a form of a sheet storage apparatus according to the present invention.

Figure 1:
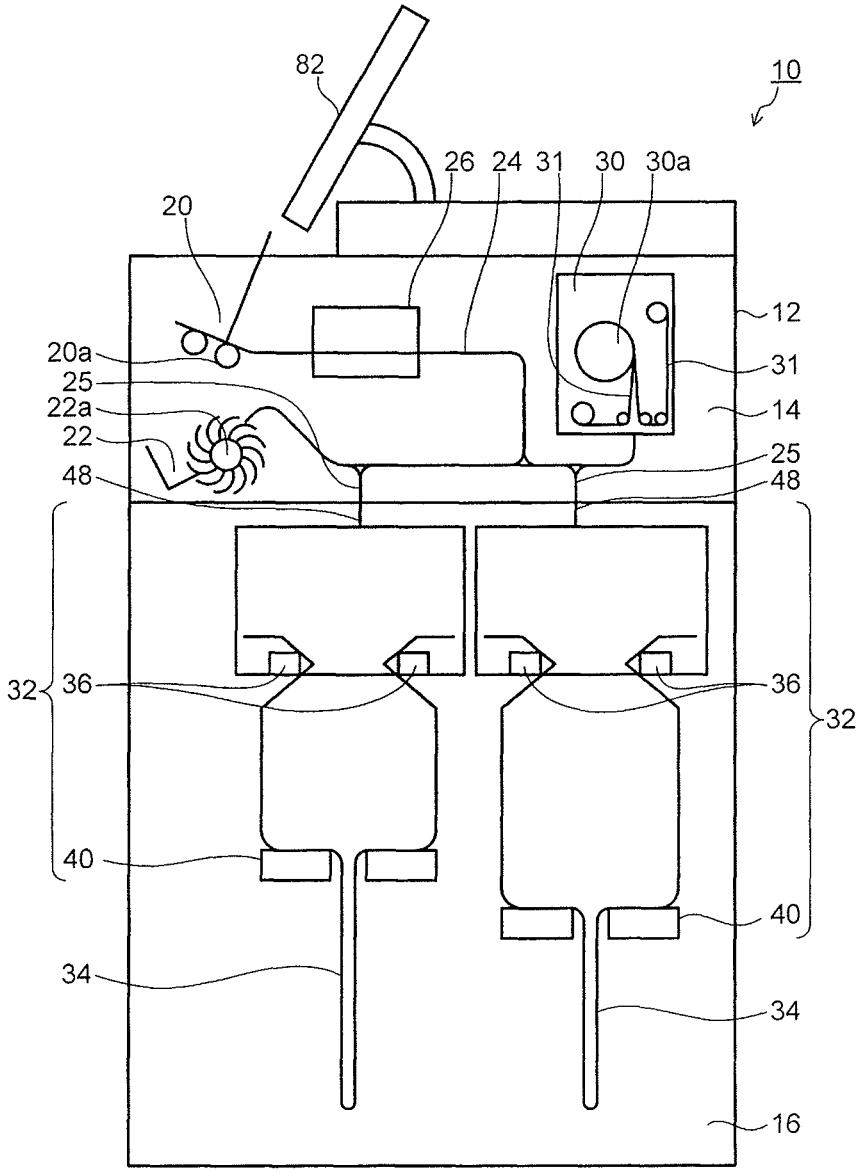
FIG. 1 is a schematic diagram of a banknote storage apparatus according to an embodiment.

FIG. 1 is a schematic diagram of a banknote storage apparatus 10 according to an embodiment. The banknote storage apparatus 10 is generally disposed in a front office region or a back office region of a store such as a supermarket and a bank. The banknote storage apparatus 10 can perform various processes such as a banknote reception process. A left side of FIG. 1 shows a front side of the banknote storage apparatus 10, that is, a side facing an operator of the banknote storage apparatus 10, and a right side of the FIG. 1 shows a back side of the banknote storage apparatus 10.

The banknote storage apparatus 10 has a substantially rectangular parallelepiped housing 12. An upper unit 14 and a lower unit 16 are housed in the housing 12 so as to be able to be each drawn forward from a front surface of the housing 12.

An inlet section 20 composed of a receiving hopper for inputting a banknote from the outside of the housing 12 into the inside is provided in the upper unit 14, specifically, in an front upper portion of the housing 12. A banknote feeding mechanism 20*a* that feeds out banknotes placed in the inlet section 20 in a stacked state, to the inside of the housing 12 one by one is provided in the inlet section 20.

A transport unit 24 that transports banknotes one by one is provided in the upper unit 14. The banknotes fed out from the inlet section 20 by the banknote feeding mechanism 20*a* is transported one by one by the transport unit 24.

A recognition unit 26 is provided in the upper unit 14, specifically, in the vicinity of the transport unit 24. The recognition unit 26 recognizes denomination, authenticity, face/back, fitness, new/old, a transport state, and the like of each banknote to be transported by the transport unit 24.

An ejection section 22 for ejecting a banknote from the inside of the housing 12 to the outside is provided in the upper unit 14, specifically, below the inlet section 20 on the front surface of the housing 12 (left surface in FIG. 1). The transport unit 24 is connected to the ejection section 22.

The ejection section 22 has a stacking wheel 22*a*. The stacking wheel 22*a* rotates in the counterclockwise direction in a state illustrated in the FIG. 1, that is, in right side view. Accordingly, the banknotes transported to the ejection section 22 by the transport unit 24 rotationally move together with the stacking wheel 22*a* in a state of being clamped between two blades that the stacking wheel 22*a* has, so that the banknotes accumulate in a state of being aligned in the ejection section 22. The ejection section 22 can be accessed from the outside of the housing 12, and an operator can take out the banknotes accumulated in the ejection section 22 from the front surface of the housing 12.

A tape type storing/feeding unit 30 is provided in the upper unit 14. The storing/feeding unit 30 is connected to the transport unit 24. The banknotes transported to the storing/feeding unit 30 are stored in the storing/feeding unit 30 by the transport unit 24. The storing/feeding unit 30 can feed out the stored banknotes to the transport unit 24 one by one. More specifically, the storing/feeding unit 30 has a drum 30*a* rotatable in the both normal and reverse directions. Respective one ends of a pair of band-like tapes 31 are connected to an outer peripheral surface of the drum 30*a*. The banknotes transported from the transport unit 24 to the storing/feeding unit 30 are wound around the drum 30*a* together with the tape 31 one by one. On the other hand, the drum 30*a* is rotated in the reverse direction, and the pair of tapes 31 are unwound from the drum 30*a*, so that the banknotes wound around the drum 30*a* are fed out to the transport unit 24.

Two diversion transport units 25 are diverted from the transport unit 24 in the upper unit 14 so as to correspond to respective banknote storage mechanisms 32 described below. The banknotes transported from the transport unit 24 to the diversion transport units 25 are sent to the banknote storage bags 34 mounted on the banknote storage mechanisms 32, and are stored in the banknote storage bags 34.

An operation display 82 is mounted on an upper front side of the upper unit 14, specifically, an upper front side of the housing 12. The operation display 82 is, for example, a touch panel. The operation display 82 displays information related to process statuses of various process such as a banknote reception process in the banknote storage apparatus 10, an inventory amount of the banknotes stored in each of the banknote storage bag 34, and the like. An operator can give various instructions to a control section 80 (refer to FIG. 11) by operating the operation display 82.

The two banknote storage mechanisms 32 are provided in the lower unit 16. Of course, the number of the banknote storage mechanisms 32 is not limited to two, and may be one, or three or more. The banknote storage mechanisms 32 are each composed of a banknote sending-out section 48, a pair of holding members 36, and stages 40.

Figure 2:
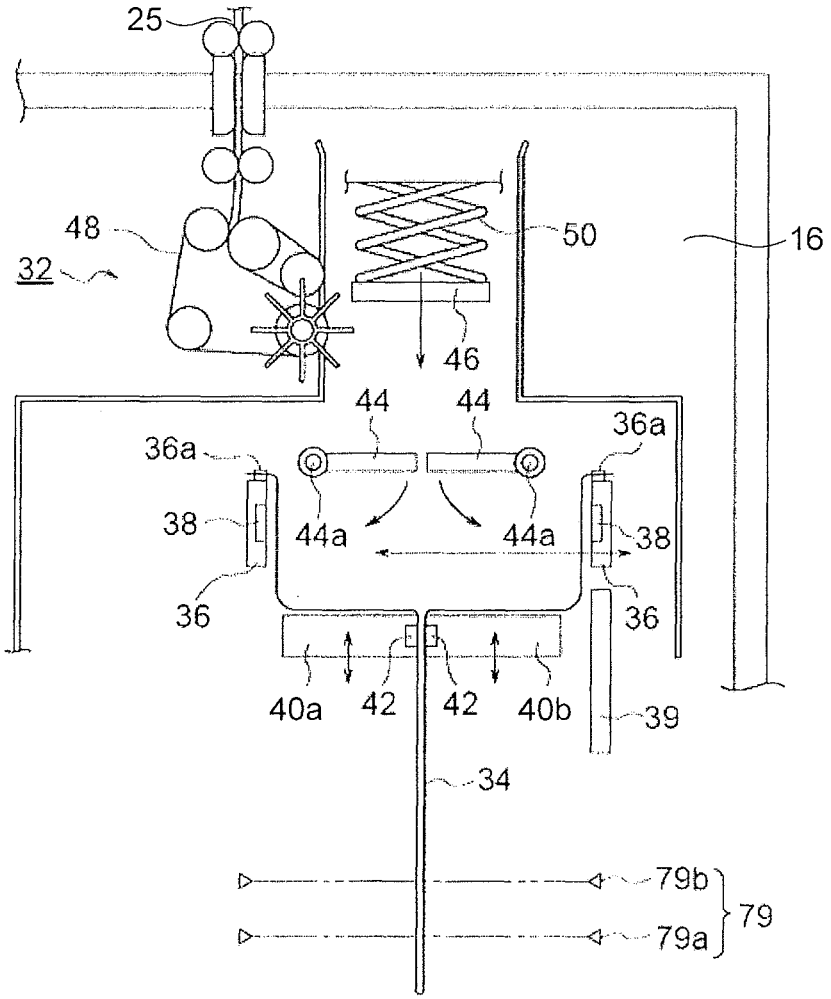
FIG. 2 is a right side view of a banknote storage mechanism.

FIG. 2 is a right side view of the banknote storage mechanism 32. Each banknote storage mechanism 32 has the pair of holding members 36. The pair of holding members 36 face each other and are separated at a predetermined distance. Each of the pair of holding members 36 holds a facing portion in the vicinity of an opening of the banknote storage bag 34.

A position of one of the pair of holding members 36 (for example, the holding member 36 on the back side) is fixed. On the other hand, the other of the pair of holding members 36 (for example, the holding member 36 on the front side) is movable toward the one (position fixing) holding member 36. Both the holding members 36 may be configured to move toward respective mating sides instead of movement of the one holding member 36 toward the other holding member 36.

A first heating member 38 is provided in each holding member 36.

When the one holding member 36 relatively moves toward the other holding member 36, and the first heating members 38 are heated in a state in which the pair of holding members 36 are in close contact with each other through the banknote storage bag 34, heat is given to a portion in the vicinity of an opening of the banknote storage bag 34. Consequently, it is possible to heat-seal the opening of the banknote storage bag 34.

Each banknote storage mechanism 32 has the banknote sending-out section 48 for sending the banknotes to the banknote storage bag 34, the banknotes being sent from the diversion transport unit 25 to the lower unit 16. Additionally, the banknote storage mechanism 32 has temporary storage sections 44 that temporarily store the banknotes sent from the banknote sending-out section 48. The banknote storage mechanism 32 has stage members 40*a*, 40*b* for placing a bottom of the banknote storage bag 34 thereon. The stage members 40*a*, 40*b* are members composing the stages 40. The temporary storage sections 44 are provided at almost the same height as the holding members 36, or at higher positions than the holding members 36. The stage members 40*a*, 40*b* are provided at lower positions than the holding members 36.

Each banknote sending-out section 48 is made up of a combination of rollers, a belt and the like. The banknote sending-out section 48 sends the banknotes onto the temporary storage sections 44 one by one, the banknotes being sent from the diversion transport units 25 to the lower unit 16.

The temporary storage sections 44 are composed of a pair of plate-like members disposed in the front-back direction (right-left direction in FIG. 2). The banknotes sent by the banknote sending-out section 48 are accumulated on the temporary storage sections 44. Shafts 44*a* are provided in base end portions of the temporary storage sections 44. A pair of the temporary storage sections 44 are each configured to be rotatable around the shaft 44*a* downward (arrow direction in FIG. 2).

At least a part of the banknote storage bag 34 held by the holding members 36 is placed on the stage members 40*a*, 40*b*.

Figure 3:
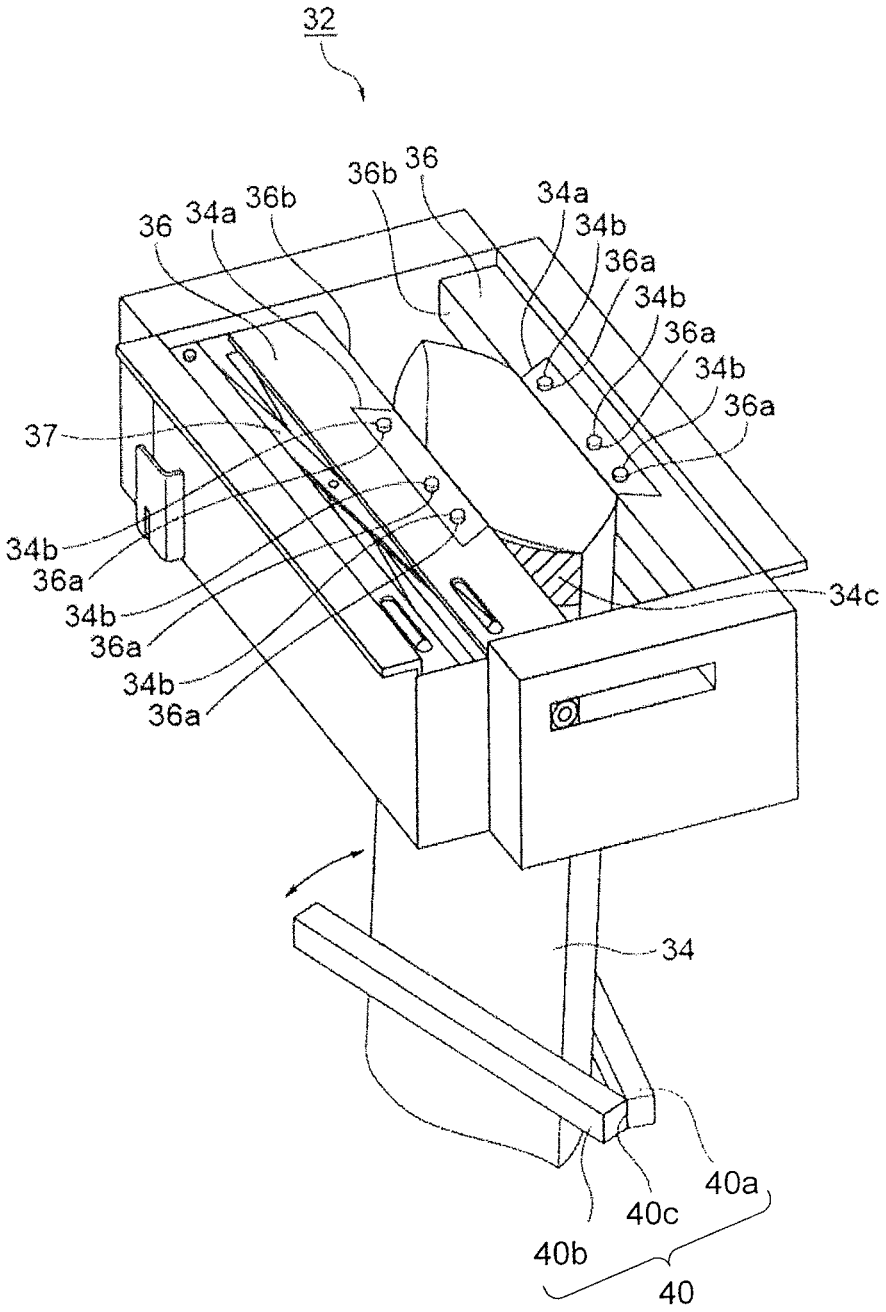
FIG. 3 is a perspective view of the banknote storage mechanism.

Herein, FIG. 3 will be referred. FIG. 3 is a perspective view of the banknote storage mechanism 32. A hinge section 40*c* is provided in ends of the stage members 40*a*, 40*b*, and the stage members 40*a*, 40*b* are coupled to each other by the hinge section 40*c*. The stage members 40*a*, 40*b* are configured to be swingable around the hinge section 40*c* in the arrow direction in FIG. 3 along a horizontal plane. When the stage members 40*a*, 40*b* are opened, a gap between the stage members 40*a*, 40*b* is formed. The banknote storage bag 34 held by the holding members 36 is disposed such that a part of the banknote storage bag 34 passes through this gap to extend below the stage members 40*a*, 40*b*. Either one of the stage members 40*a*, 40*b* may be swingable.

The stage members 40*a*, 40*b* are driven by a stage driving section 41 (refer to FIG. 11) such as an electrical actuator. Specifically, the stage members 40*a*, 40*b* are moved in the vertical direction by the stage driving section 41, and closed and opened along the horizontal plane with the hinge section 40*c* as the center.

FIG. 2 will be referred again. The stage members 40*a*, 40*b* are configured to be movable in the direction away from the pair of holding members 36 and in the direction approaching the pair of holding members 36 in a predetermined movement range. That is, in a case of this embodiment, the stage members 40*a*, 40*b* are configured to be movable in the vertical direction in the predetermined movement range. The stage members 40*a*, 40*b* are mounted with detected sections (not illustrated).

The banknote storage mechanism 32 comprises a stage position detecting sensor 79 that detects a vertical position of the stage members 40*a*, 40*b*. The stage position detecting sensor 79 comprises a first sensor 79*a* and a second sensor 79*b*.

When the stage members 40*a*, 40*b* are located at a first position that is a lower end of a movable range of the stage members 40*a*, 40*b*, the first sensor 79*a* detects the detected sections mounted on the stage members 40*a*, 40*b*. When the stage members 40*a*, 40*b* are located at a second position that is above the first position by a predetermined distance, the second sensor 79*b* detects the respective detected sections mounted on the stage members 40*a*, 40*b*. When the stage members 40*a*, 40*b* are lowered to the first position, the control section 80 (refer to FIG. 11) determines that the banknotes stored in the banknote storage bag 34 are brought into a full state. When the stage members 40*a*, 40*b* are lowered to the second position, the control section 80 determines that the banknotes stored in the banknote storage bag 34 is brought into a nearly full state. The control section 80 may determine that the banknote storage bag 34 is brought into the full state at a time point when the stage members 40*a*, 40*b* are lowered to the second position.

Respective second heating members 42 are provided in the stage members 40*a*, 40*b*. These second heating members 42 can heat-seal the banknote storage bag 34. Specifically, before the banknote storage bag 34 is taken from the banknote storage mechanism 32, the second heating member 42 provided in the one stage member 40*a* moves toward the second heating member 42 provided in the other stage member 40*b*, and these second heating members 42 are brought into a mutually close state. In this state, heat from each second heating member 42 is given to a portion that becomes the bottom when the banknotes are stored in the banknote storage bag 34, so that the portion is heat-sealed.

The stage members 40*a*, 40*b* has a fall prevention structure in which the banknotes stored in the banknote storage bag 34 are prevented from fall between the stage members 40*a*, 40*b*. This will be described below in detail.

A one-side displacement lever 39 is provided below the one holding member 36 of the pair of holding members 36. The one-side displacement lever 39 is a member for displacing the banknotes stored in the banknote storage bag 34 to one side (left in the case of FIG. 2) in the banknote storage bag 34. The one-side displacement lever 39 is moved to the left from the state illustrated in FIG. 2 by a one-side displacement lever driving section 39*a* (refer to FIG. 11) composed of an electrical actuator and the like, and is moved to the state illustrated in FIG. 2 again.

Figure 4:
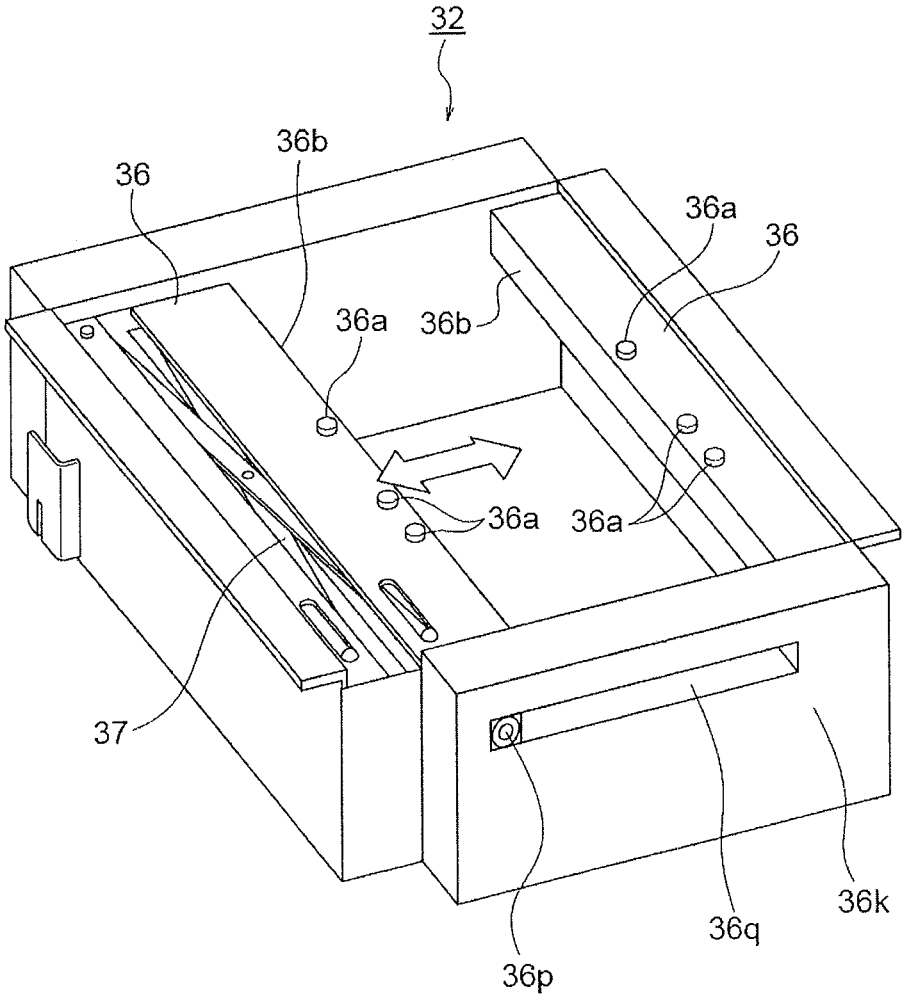
FIG. 4 is a perspective view of holding members and the like composing the banknote storage mechanism.

FIG. 4 is a perspective view of the holding members 36 and the like. A slide mechanism 37 composed of a plurality of links is provided in the one holding members 36 (left of FIG. 4) of the pair of holding members 36. The slide mechanism 37 extends in the lateral direction, so that the one holding member 36 moves toward the other holding member 36.

A guide pin 36*p* is provided in an end of the one holding member 36. A linear long hole 36*q* that extends in the horizontal direction is provided in a frame body 36*k* that supports the holding members 36. The long hole 36*q* guides the guide pin 36*p*. When the slide mechanism 37 extends, the one holding member 36 moves toward the other holding member 36 while the guide pin 36*p* provided in the one holding member 36 is guided along the long hole 36*q*. By such movement, a surface 36*b* of the one holding member 36 comes close to a surface 36*b* of the other holding member 36.

Three pins 36*a* are provided on each of upper surfaces of the pair of holding members 36.

Figure 5:
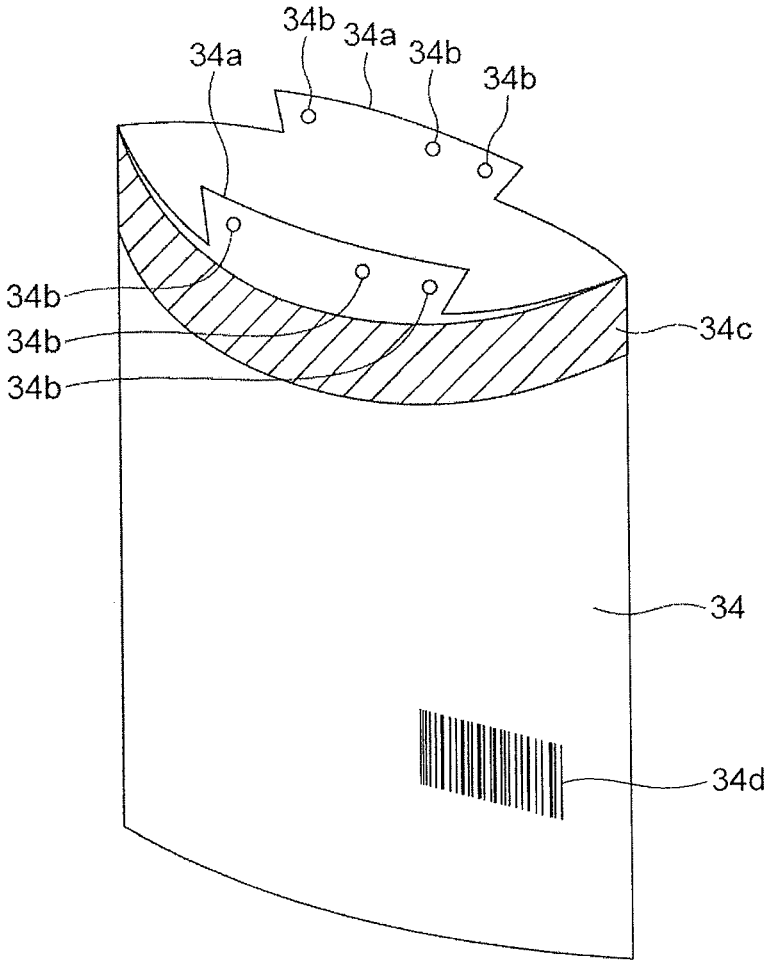
FIG. 5 is a perspective view of a banknote storage bag held by the holding member.

FIG. 5 is a perspective view of the banknote storage bag 34 to be held by the holding members 36. A pair of protrusions 34*a* are provided in portions in the vicinity of the opening of the banknote storage bag 34 (that is, an upper end of the banknote storage bag 34). Three holes 34*b* are provided in each protrusion 34*a*. Each pin 36*a* passes through a corresponding one of the holes 34*b* (refer to FIG. 3), and the protrusions 34*a* are held by the holding members 36, so that the banknote storage bag 34 is held by the pair of holding members 36.

As illustrated in FIG. 5, a band-like reinforcing member 34*c* is provided (stuck) on a portion in the vicinity of the opening on an outer surface of the banknote storage bag 34. The reinforcing member 34*c* is formed of a material having rigidness than other portions of the banknote storage bag 34, for example, polyethylene terephthalate. The reinforcing member 34*c* prevents wrinkles from occurring on the opening of the banknote storage bag 34. Herein, the "rigidness" means that rigidity to bending is large. As the material forming the reinforcing member 34*c*, a more flexibility material than other portions of the banknote storage bag 34 may be used. Also in this case, the reinforcing member 34*c* as other member is provided, so that the stiffness near the opening of the banknote storage bag 34 becomes stronger than the stiffness of other portions. Accordingly, occurrence of wrinkle on the opening is suppressed.

An identifier 34*d* such as a bar code may be printed on one surface of the banknote storage bag 34. For example, the identifier 34*d* printed on the banknote storage bag 34 is read by a reading apparatus or the like, so that the banknote storage apparatus 10 can recognize which banknote storage bag 34 is held by the holding member 36.

Referring to FIG. 2 again, description of the banknote storage mechanisms 32 will be continued. A press-in plate 46 is provided above the pair of temporary storage sections 44. A pantograph 50 is connected to an upper portion of the press-in plate 46. The pantograph 50 extends/contracts in the vertical direction, so that the press-in plate 46 moves in the vertical direction. That is, the pantograph 50 is one kind of an advancing/retreating section that advances/retreats the press-in plate 46. The pantograph 50 is a member made up of a plurality of links (50*a* to 50*f*, refer to FIG. 8) coupled through hinges.

Figure 6:
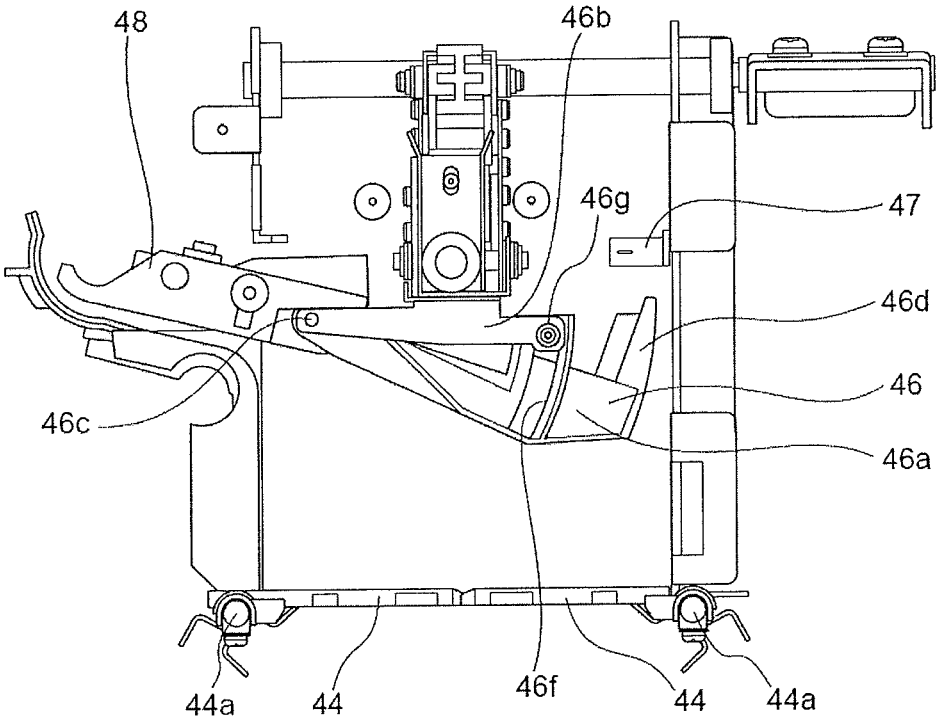
FIG. 6 is a right side view of a press-in plate, a temporary storage section, and the like composing the banknote storage mechanism.
Figure 7:
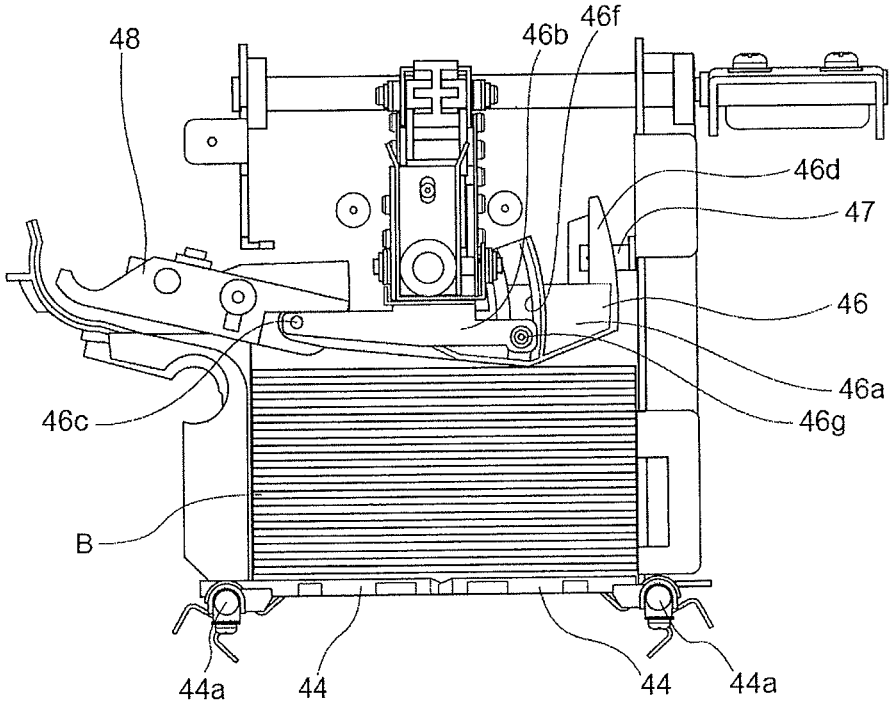
FIG. 7 is a side view of the press-in plate, the temporary storage section, and the like when banknotes are stored in the temporary storage section in a full state or a nearly full state.

Next, a configuration of the press-in plate 46 will be described in detail with reference to FIG. 6 and FIG. 7 that are side views each illustrating a configuration of the press-in plate 46, the temporary storage sections 44, and the like. FIG. 6 illustrates a state in which any banknote is not stored in the temporary storage sections 44, and FIG. 7 illustrates a state in which a banknote bundle B is stored in the temporary storage sections 44 in a full state or a nearly full state.

The press-in plate 46 has a press-in portion 46*a* and a base portion 46*b*. The press-in portion 46*a* is swingable around a shaft 46*c* with respect to the base portion 46*b*. More specifically, an arcuate guide hole 46*f* is provided in the press-in portion 46*a*, and a pin member 46*g* to be inserted in the guide hole 46*f* is provided in the base portion 46*b*. The press-in portion 46*a* is swingable around the shaft 46*c* with respect to the base portion 46*b* in a range in which the pin member 46*g* moves in the guide hole 46*f*.

In a case in which any force is not applied to the press-in portion 46*a*, as illustrated in FIG. 6, the press-in portion 46*a* is maintained at such a position as to protrude below the base portion 46*b* by its own weight.

The banknote sending-out section 48 is disposed between the temporary storage sections 44 and the press-in plate 46 (refer to FIG. 2). Accordingly, the banknotes sent from the banknote sending-out section 48 is sent between the temporary storage sections 44 and the press-in plate 46, and accumulated. At this time, the press-in plate 46 also functions as a guide that guides the banknotes. The stacked height of the banknote is increased with increase of an amount of the accumulated banknotes, and the press-in portion 46*a* is pressed upward by the banknotes. Then, the press-in portion 46*a* rotates around the shaft 46*c* in the counterclockwise direction in FIG. 6. When the height of the banknote accumulated on the temporary storage sections 44 becomes a predetermined height, most part of the press-in portion 46*a* retreats above the base portion 46*b* as illustrated in FIG. 7.

A detected member 46*d* is mounted on an upper portion of the press-in portion 46*a*. A temporary storage amount detecting sensor 47 that detects the detected member 46*d* is provided above the press-in portion 46*a*. When the height of the banknotes accumulated on the temporary storage sections 44 becomes a predetermined height, and the height of the detected member 46*d* becomes the same as the height of the temporary storage amount detecting sensor 47, the temporary storage amount detecting sensor 47 detects that the detected member 46*d* reaches the predetermined height. That is, the temporary storage amount detecting sensor 47 detects that the banknotes having the predetermined height are stacked on the temporary storage sections 44, that is, the banknotes stored on the temporary storage sections 44 are brought into the full state or the nearly full state.

Next, operation of the temporary storage sections 44 and the press-in plate 46 will be described with reference to FIG. 8 and FIG. 9 that are perspective views of surrounding of the temporary storage sections 44 and the press-in plate 46.

Figure 8:
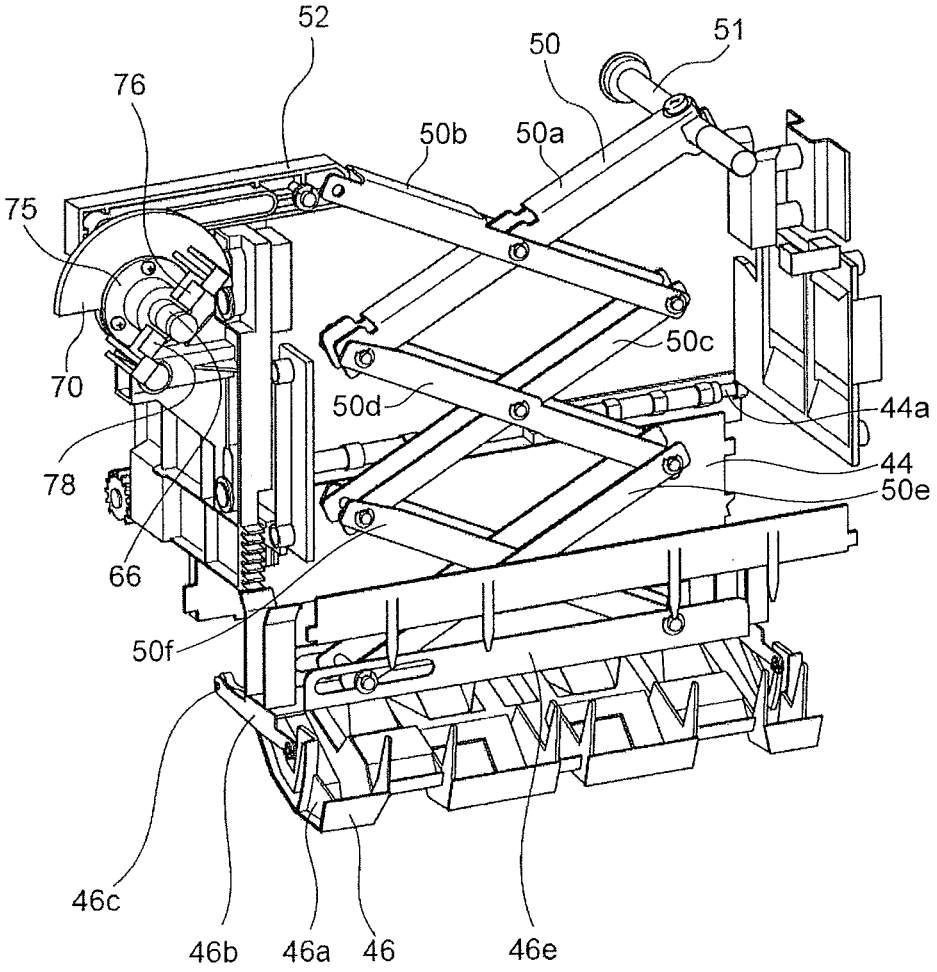

FIG. 8 illustrates a state in which each of the pair of temporary storage sections 44 rotates around the shaft 44*a* downward, a gap is formed between the pair of temporary storage sections 44, and the press-in plate 46 passes through this gap to be lowered. For convenience' sake, in FIG. 8, illustration of one of the pair of temporary storage sections 44 (front side in the paper surface direction of FIG. 8) is omitted.

A mounting member 46*e* is mounted on an upper surface of the base portion 46*b* of the press-in plate 46. Two lower ends of the pantograph 50 are mounted on the mounting member 46*e*.

One of the two lower ends of the pantograph 50 (link 50*f*) is rotatably mounted on the mounting member 46*e* through a hinge. The other of the two lower ends of the pantograph 50 (link 50*e*) is provided in the mounting member 46*e*, and is slidably mounted on the mounting member 46*e* through a slide pin movable in the horizontal direction in the horizontal long hole extending in the horizontal direction.

One of the two upper ends of the pantograph 50 (link 50*a*) is rotatable around a shaft 51 mounted on the upper end. The other of the two upper ends of the pantograph 50 (link 50*b*) is rotatably mounted on an end of a rack 52 through a hinge, the rack 52 being moved in the horizontal direction by a pinion (not illustrated).

When the rack 52 is moved in the direction approaching the shaft 51 by the pinion (not illustrated), the pantograph 50 extends downward. Accordingly, the press-in plate 46 mounted on the lower ends of the pantograph 50 moves downward. On the contrary, when the rack 52 is moved in the direction away from the shaft 51 by the pinion, the pantograph 50 contracts upward. Accordingly, the press-in plate 46 mounted on the lower ends of the pantograph 50 moves upward.

Figure 9:
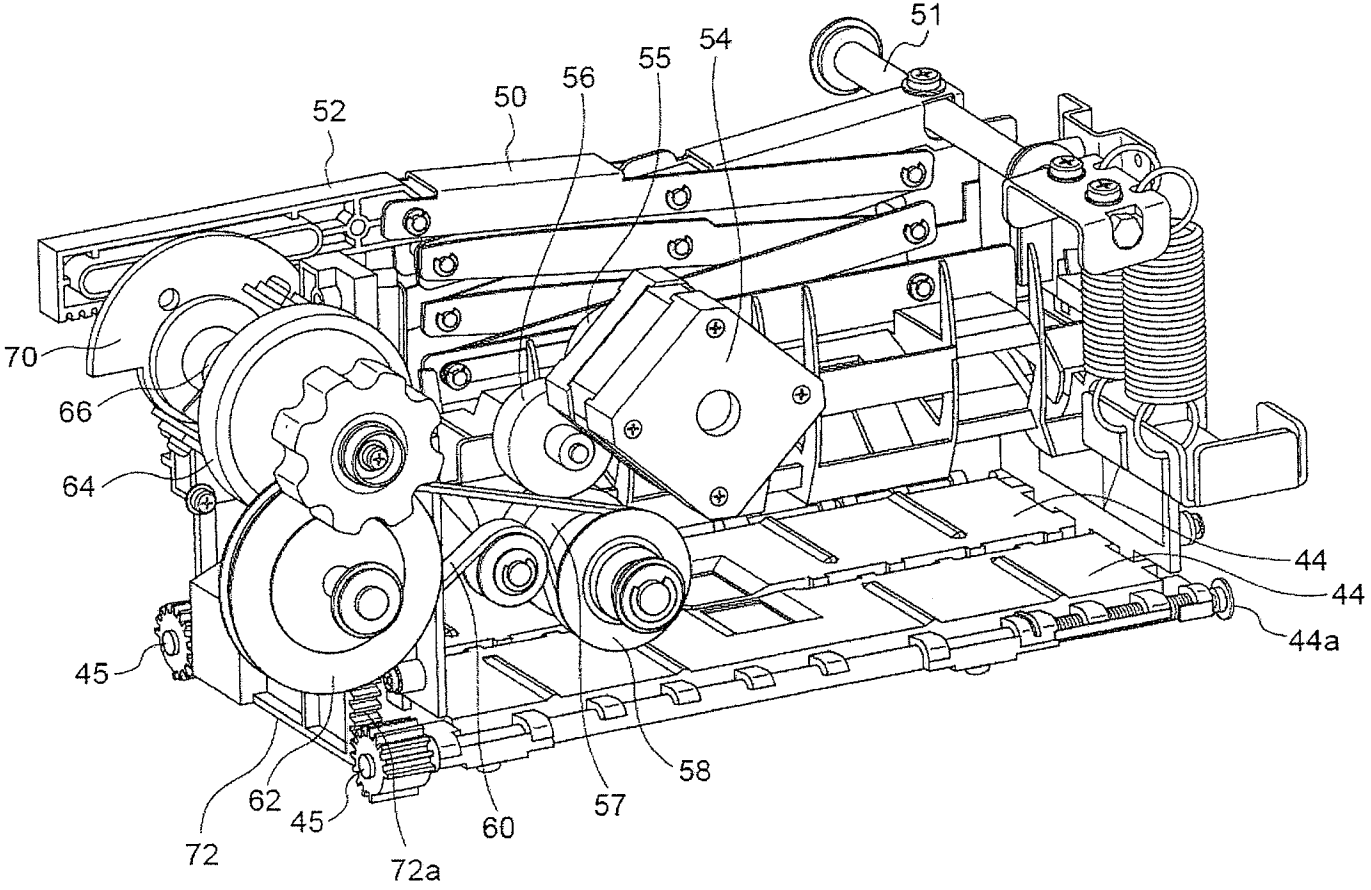

FIG. 9 illustrates a state in which the pair of temporary storage sections 44 becomes horizontal, the pantograph 50 contracts, and the press-in plate 46 is located above the pair of temporary storage sections 44.

A stepper motor 54 is disposed in the vicinity of the temporary storage sections 44 and the press-in plate 46. A gear 55 is mounted on the stepper motor 54, and when the stepper motor 54 is actuated by a predetermined number of steps, the gear 55 is rotated by a predetermined angle in the both normal and reverse directions. Another gear 56 meshes with the gear 55, and this gear 56 meshes with further another gear 57.

A pulley 58 is provided in a rotating shaft of the gear 57 so as to rotate in synchronization with the gear 57.

A circulating belt 60 is stretched upon the pulley 58. The circulating belt 60 is stretched upon another pulley 62. Furthermore, a gear (not illustrated) is mounted on a rotating shaft of this pulley 62 so as to rotate in synchronization with the pulley 62. Another gear 64 meshes with this gear. The gear 64 rotates around a rotating shaft 66.

Accordingly, when the gear 55 is rotated by a predetermined angle in the normal direction or the reverse direction by the stepper motor 54, the rotating shaft 66 rotates in the normal direction or the reverse direction.

FIG. 8 will be referred again. A pinion (not illustrated), a first cam 70, a second cam 71 (refer to FIG. 10A and FIG.

10B), and a detected plate 75 are mounted on the rotating shaft 66. When the rotating shaft 66 is rotated by a predetermined angle, these pinion, first cam 70, second cam 71 and detected plate 75 also rotate around the rotating shaft 66 by a predetermined angle. When the pinions rotate around the rotating shaft 66 by the predetermined angle, the rack 52 that meshes with the pinion is moved at a predetermined distance in the direction approaching the shaft 51 or in the direction away from the shaft 51, and the pantograph 50 extends and contracts by a predetermined length.

That is, the stepper motor 54 is a driving source that outputs driving force for driving the pantograph 50.

Two sensors (specifically, an upper-end detecting sensor 76 and a lower-end detecting sensor 78) for detecting the detected plate 75 are provided in the vicinity of the rotating shaft 66. When the pantograph 50 completely contracts, and the press-in plate 46 is located at an upper end (standby position) in a movable range of the press-in plate 46, the detected plate 75 is detected by the upper-end detecting sensor 76. When the pantograph 50 completely extends, and the press-in plate 46 is located at a lower end in the movable range of the press-in plate 46, the detected plate 75 is detected by the lower-end detecting sensor 78.

FIG. 9 will be referred again. A power transmission member 72 is disposed in the vicinity of the first cam 70. The power transmission member 72 is a substantially rectangular plate-like member. The power transmission member 72 is disposed in a state of extending in the vertical direction.

Tooth portions 72*a* are formed in at least lower ends of both side edges of the power transmission member 72. Gears 45 are mounted on ends of respective shafts 44*a* of the pair of temporary storage sections 44. The gears 45 mesh with the tooth portions 72*a*.

Upward external force is always applied to the power transmission member 72 by a spring or the like (not illustrated).

A cylindrical first contactor (not illustrated) is rotatably mounted on the power transmission member 72. An outer peripheral surface of this first contactor is disposed so as to be in contact with an outer peripheral surface of the first cam 70.

Figure 10A:
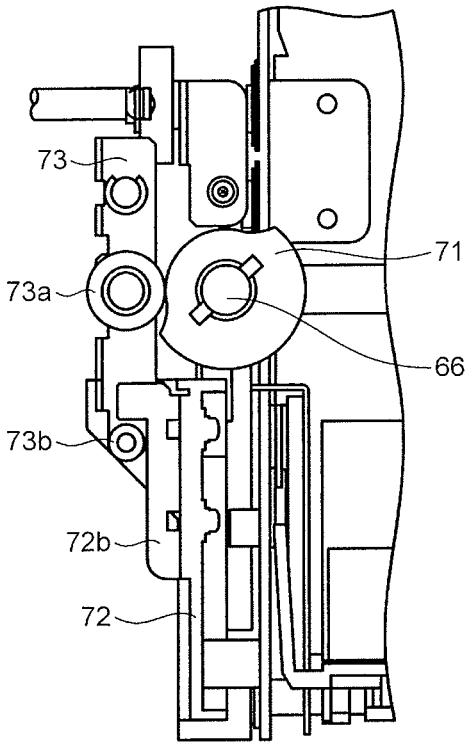
Figure 10B:
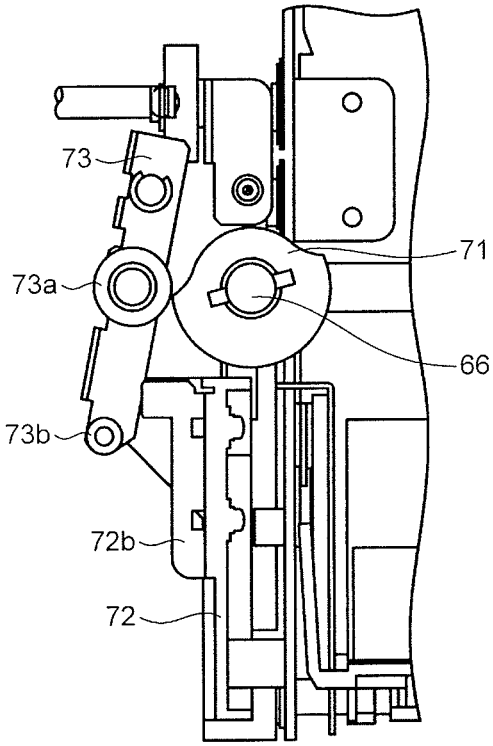

Herein, FIGS. 10A and 10B will be referred. FIGS. 10A and 10B each are a rear view of the second cam 71 and the like mounted on the rotating shaft 66. A lock member 73 that regulates movement of the power transmission member 72 is provided on the left of the second cam 71 in each of FIGS. 10A and 10B. The lock member 73 has an upper end pivotally supported by a pin, and swings around the pin. The lock member 73 is urged on the right in FIGS. 10A and 10B by an urging member such as a coil spring. A second contactor 73*a* is mounted near the center of the lock member 73 so as to be in contact with an outer peripheral surface of the second cam 71. A cylindrical locking member 73*b* is mounted on a lower end of the lock member 73.

On the other hand, a lock plate 72*b* having a protrusion caught by the locking member 73*b* of the lock member 73 is mounted on the power transmission member 72. FIG. 10A illustrates a state in which the locking member 73*b* is caught by the protrusion of the lock plate 72*b*, and the power transmission member 72 cannot move downward, that is, a lock state.

When the rotating shaft 66, the first cam 70, and the second cam 71 rotate in the clockwise direction in FIG. 9 to FIG. 10B by rotation of the stepper motor 54, the second contactor 73*a* provided in the lock member 73 moves along the outer peripheral surface of the second cam 71, and the lock member 73 swings around a pin. Consequently, catching between the locking member 73*b* provided in the other end of the lock member 73, and the protrusion of the lock plate 72*b* provided in the power transmission member 72 is released, and the power transmission member 72 is brought into a state of being movable downward, that is, a lock release state.

Furthermore, when the rotating shaft 66, the first cam 70, and the second cam 71 are rotated by rotation of the stepper motor 54, the first contactor is pressed downward by the outer peripheral surface of the first cam 70. Then, the power transmission member 72 moves downward against the aforementioned external force. Then, the gears 45 are rotated by the tooth portions 72*a* that move downward. Accordingly, the temporary storage sections 44 rotate around the shafts 44*a* downward.

Furthermore, when the rotating shaft 66, the first cam 70, and the second cam 71 rotate in the reverse direction by rotation of the stepper motor 54 in the reverse direction, the first contactor is pressed up along the outer peripheral surface of the first cam 70 by the aforementioned external force. Then, the gears 45 are rotated by the tooth portions 72*a* that move upward. Accordingly, the temporary storage sections 44 rotate around the shafts 44*a* upward. Consequently, the temporary storage sections 44 are closed.

Furthermore, when the rotating shaft 66, the first cam 70, and the second cam 71 rotate in the reverse direction by rotation of the stepper motor 54 in the reverse direction, the second contactor 73*a* provided in the lock member 73 moves to the right in FIGS. 10A and 10B along the outer peripheral surface of the second cam 71. As a result, the protrusion of the lock plate 72*b* is caught by the locking member 73*b*, and the power transmission member 72 is brought into the lock state for regulating downward movement of the power transmission member 72 again.

Figure 11:
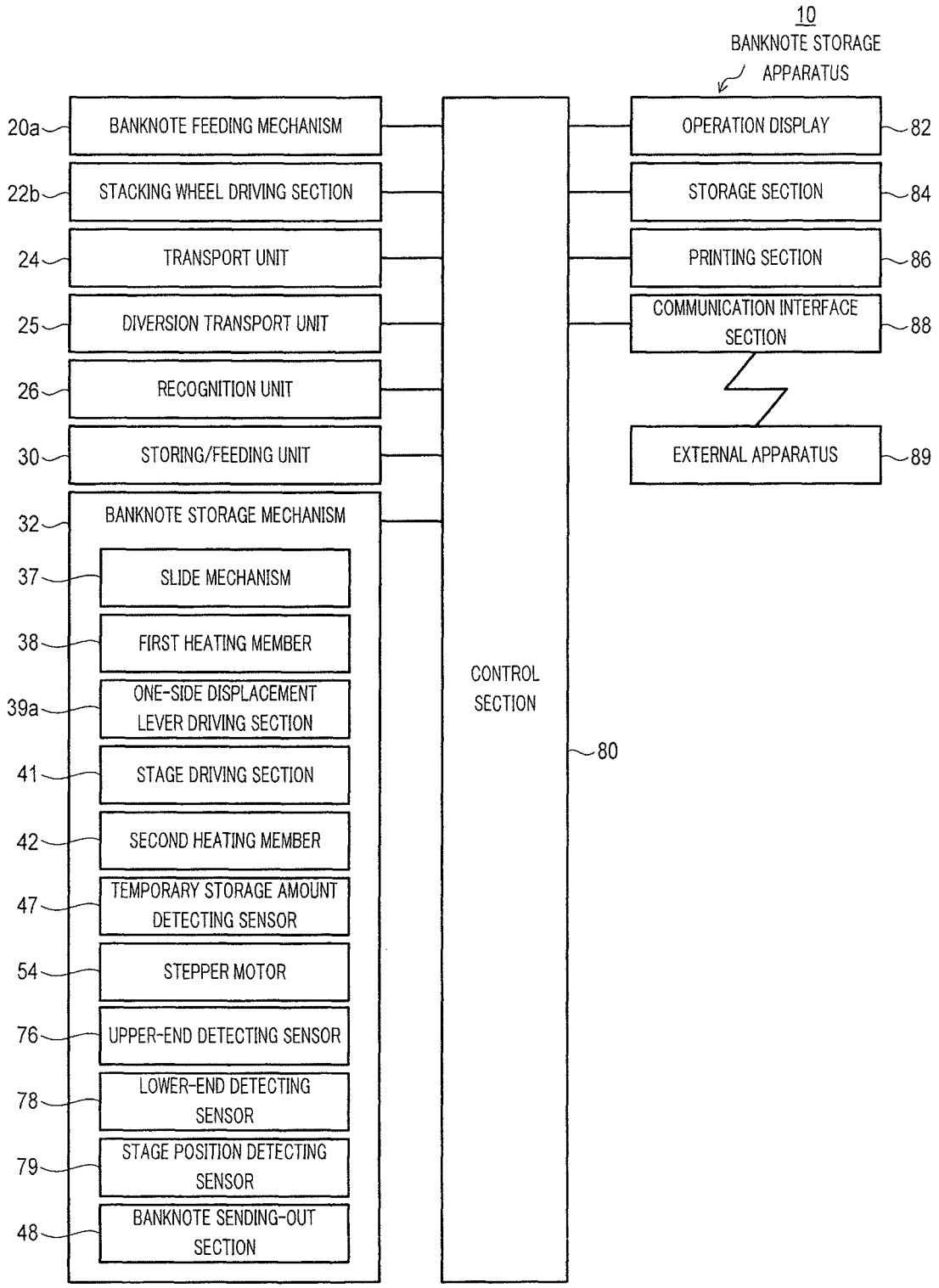
FIG. 11 is a function block diagram illustrating a configuration of a control system of the banknote storage apparatus.

FIG. 11 is a function block diagram illustrating a configuration of a control system of the banknote storage apparatus 10. The banknote storage apparatus 10 comprises the control section 80.

The control section 80 is connected to the banknote feeding mechanism 20*a* provided in the inlet section 20, and a stacking wheel driving section 22*b* for driving the stacking wheel 22*a* provided in the ejection section 22, the transport unit 24, the diversion transport units 25, the recognition unit 26, and the storing/feeding unit 30. The control section 80 is connected to the banknote storage mechanisms 32. The banknote storage mechanisms 32 each have the slide mechanism 37, the first heating members 38, the one-side displacement lever driving section 39*a*, the stage driving section 41, the second heating members 42, the temporary storage amount detecting sensor 47, the stepper motor 54, the upper-end detecting sensor 76, the lower-end detecting sensor 78, the stage position detecting sensor 79, and the banknote sending-out section 48.

Information of a recognition result of each banknote by the recognition unit 26, and detection information by the temporary storage amount detecting sensor 47, the upper-end detecting sensor 76, the lower-end detecting sensor 78 and the stage position detecting sensor 79 are transmitted to the control section 80. The control section 80 controls the respective sections composing the banknote storage apparatus 10 on the basis of these pieces of information.

The operation display 82, a storage section 84, a printing section 86, and a communication interface section 88 are connected to the control section 80. The operation display 82 is the section described above.

The storage section 84 stores processing histories such as a reception process of the banknote in the banknote storage apparatus 10, information related to the respective inventory amounts of the banknotes stored in the banknote storage bags 34.

The printing section 86 prints the processing histories such as a reception process of the banknote in the banknote storage apparatus 10, the information related to the respective inventory amounts of the banknotes stored in the banknote storage bags 34, and the like, on a receipt or the like.

The control section 80 can receive and transmit the information from and to an external apparatus 89 (specifically, a host terminal, for example) provided separately from the banknote storage apparatus 10, through the communication interface section 88. For example, the information stored in the storage section 84 is transmitted to the external apparatus 89. Specifically, for example, when a guard of a security transportation company collects banknotes together with the banknote storage bag 34, information related to banknotes to be collected is transmitted to a computer of the security transportation company that is the external apparatus 89.

Now, operation of the banknote storage apparatus 10 when the banknotes are stored in the banknote storage bag 34 will be described. Operation of each section composing the banknote storage apparatus 10 is performed by each section under control of the control section 80.

When the operation display 82 is operated by an operator, and banknotes are input to the inlet section 20, the banknotes input to the inlet section 20 are fed out into the housing 12 one by one, and are transported by the transport unit 24. Then, denomination, authenticity, face/back, fitness, new/old, a transport state, and the like of each banknote are recognized by the recognition unit 26.

Banknotes that are recognized as a normal banknote by the recognition unit 26 are sent to the storing/feeding unit 30 to be temporarily stored in the storing/feeding unit 30. The number and the amount of the banknotes temporarily stored in the storing/feeding unit 30 every denomination are displayed on the operation display 82. When the operator that confirms a display content performs approval operation of the banknote reception process, the banknotes are fed out from the storing/feeding unit 30 to the transport unit 24 one by one. The banknotes are transported onto the pair of temporary storage sections 44 disposed on an upper portion of the banknote storage bag 34 in which the banknotes are to be stored, through the transport unit 24, the diversion transport unit 25, and the banknote sending-out section 48, and are accumulated.

The control section 80 receives the information of the recognition result by the recognition unit 26, and counts and stores the number of the banknotes accumulated on the pair of temporary storage sections 44, on the basis of the information. The control section 80 accumulates the number of the banknotes, so that the number of the banknotes stored in the banknote storage bag 34 is counted and stored. A sensor that detects banknotes which pass through the banknote sending-out section 48 may be provided, and the control section 80 may count the number of the banknotes accumulated on the pair of temporary storage sections 44 on the basis of output of this sensor.

Banknotes that are failed to be recognized as normal banknotes by the recognition unit 26, so-called reject banknotes are sent to the ejection section 22 by the transport unit 24 to be accumulated on the ejection section 22. The operator can take out the reject banknotes accumulated on the ejection section 22 from a front surface of the housing 12, and input the reject banknotes to the inlet section 20 again as necessary.

The banknotes that are input to the inlet section 20, and recognized as normal banknotes by the recognition unit 26 may not be sent to the storing/feeding unit 30 but may be directly sent to the temporary storage sections 44.

When the banknote bundle B composed of, a predetermined number of, for example, 100 sheets of the banknotes are accumulated on the pair of temporary storage sections 44, the stepper motor 54 rotates. Then, each temporary storage section 44 rotates around the shaft 44*a* downward (that is, in the arrow directions in FIG. 2). Accordingly, the banknote bundle B on the pair of temporary storage sections 44 falls by its own weight while keeping a vertically accumulated state, and is stored in the banknote storage bag 34. In a case in which a banknote bundle B already stored in the banknote storage bag 34 exists, the banknote bundle B accumulated on the pair of temporary storage sections 44 falls on the banknote bundle B.

When the stepper motor 54 rotates, the pantograph 50 extends downward, and the press-in plate 46 moves downward. Accordingly, when the banknote bundle B temporarily stored on the pair of temporary storage sections 44 falls and is stored in the banknote storage bag 34, the press-in plate 46 can press an upper surface of the banknote bundle B, and maintain a stacked state of the banknote bundle B. Even when a part of the banknotes remain on the temporary storage sections 44, the banknotes are pressed into the banknote storage bag 34 by the press-in plate 46.

When the banknote bundle B moves from the temporary storage sections 44 into the banknote storage bag 34, the stage members 40*a*, 40*b* are moved downward by the stage driving section 41 by a stacked height amount of the banknote bundle B that moves. Then, the press-in plate 46 moves to an upper end in the movable range, that is, a standby position. Accordingly, a space for storing a banknote bundle B that moves from the temporary storage sections 44 into the banknote storage bag 34 next is formed in the banknote storage bag 34, specifically, above the banknote bundle B stacked in the banknote storage bag 34.

Until the banknote storage bag 34 is brought into the full state or the nearly full state, accumulation of banknotes onto the temporary storage sections 44, and storage of banknotes into the banknote storage bag 34 by the banknote storage mechanisms 32 can be repeated. The stage position detecting sensor 79 detects that the stage members 40*a*, 40*b* reaches the first position or the second position, so that it is detected that the banknote storage bag 34 is brought into the full state or the nearly full state.

When the banknote storage bag 34 is brought into the full state or the nearly full state, or at timing when the banknote storage bag 34 is collected, the one holding member 36 moves toward the other holding member 36, the pair of holding members 36 come into close contact through the banknote storage bag 34. In this state, the first heating members 38 are heated, so that the opening of the banknote storage bag 34 is heat-sealed. Furthermore, the second heating member 42 provided in the one stage member 40*a* moves toward the second heating member 42 provided in the other stage member 40*b*, these second heating members 42 are mutually brought into a close state. In this state, heat from each second heating member 42 is given to a portion that becomes the bottom when the banknotes are stored in the banknote storage bag 34, so that the portion is heat-sealed. Consequently, storage of the banknotes into the banknote storage bag 34 is completed.

When the temporary storage sections 44 rotate downward, the temporary storage sections 44 sometimes do not return upward due to catching between the temporary storage sections 44 that enter the banknote storage bag 34, and an inner surface of the banknote storage bag 34. In this case, the catching between the temporary storage sections 44 and the banknote storage bag 34 is released by retry operation. This will be described below in detail.

Figure 12A:
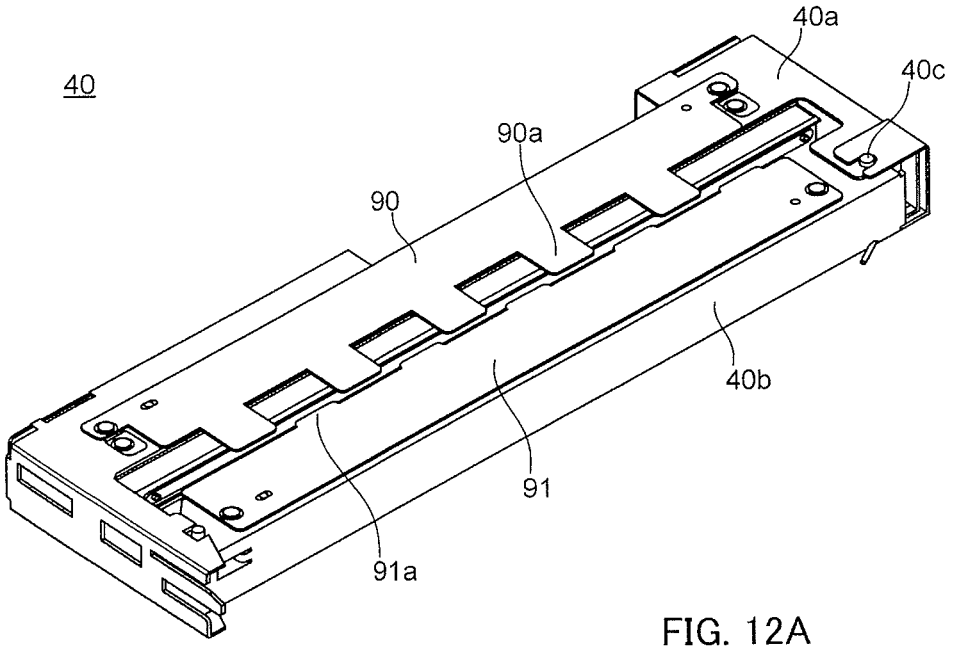
FIG. 12A is a perspective view of a pair of stages in a closed state.
Figure 12B:
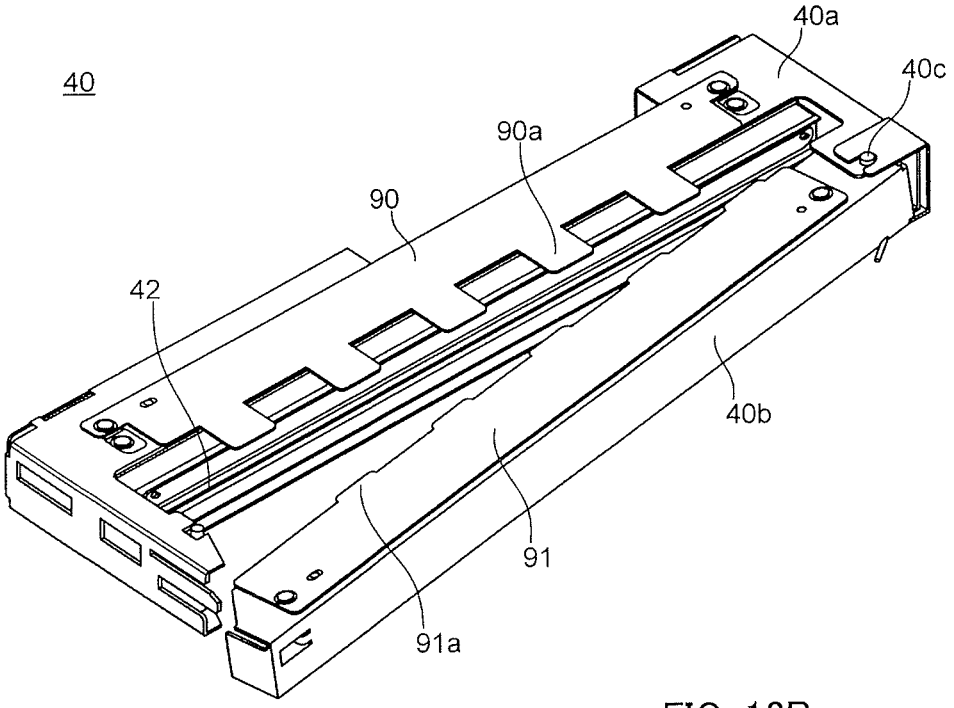
FIG. 12B is a perspective view of the pair of stages in an open state.
Figure 13:
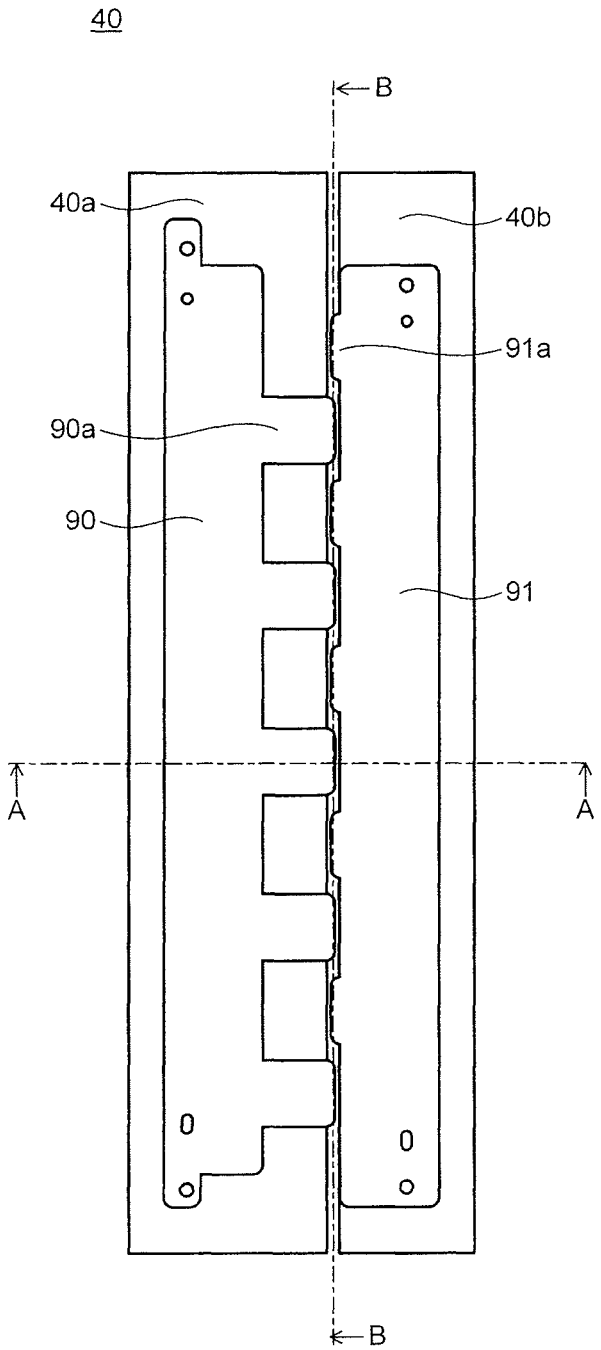
FIG. 13 is a plan view of the pair of stages.
Figure 14:
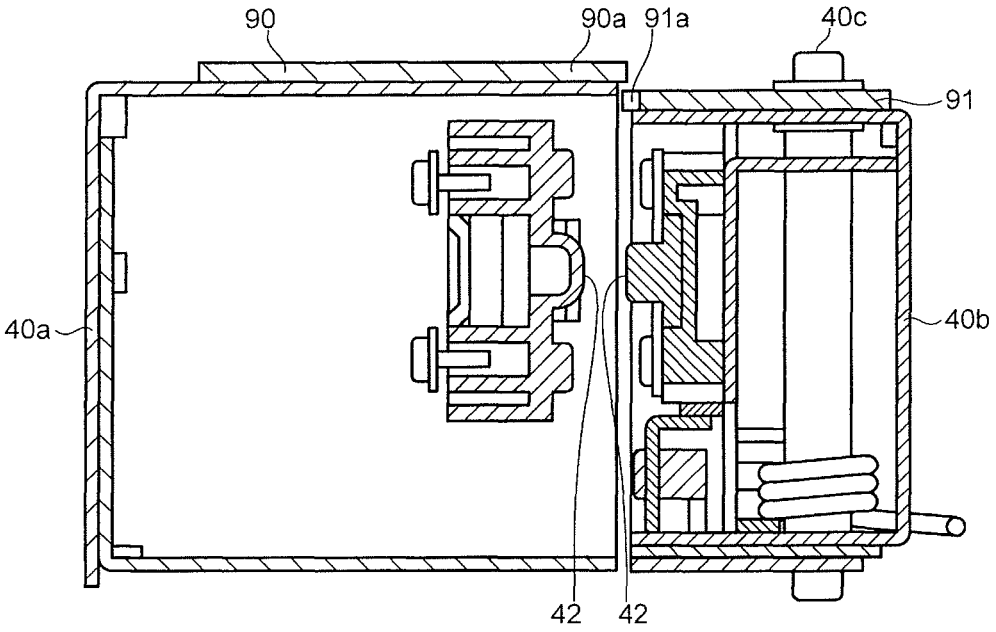
FIG. 14 is a sectional view taken along the line A-A of FIG. 13.

Now, a banknote fall prevention structure provided in the stage members 40*a*, 40*b* will be described with reference to FIG. 12A to FIG. 14. FIG. 12A is a perspective view of a pair of stages 40 in a closed state, and FIG. 12B is a perspective view of the pair of stages 40 in an open state. FIG. 13 is a plan view of the pair of stages 40, and FIG. 14 is a sectional view taken along the line A-A of FIG. 13.

In a case in which the banknotes are accumulated in the banknote storage bag 34 in a state of being inclined to the stage members 40*a*, 40*b*, an end of the banknote enters a gap between the stage member 40*a* and the stage member 40*b*, so that the banknote may falls from the gap. Therefore, the stage members 40*a*, 40*b* comprise a banknote fall prevention structure for preventing the banknote stored in the placed banknote storage bag 34 from falling from the gap between the stage members 40*a*, 40*b*.

The banknote fall prevention structure is composed of, for example, a first clamping section 90 and a second clamping section 91 mounted on upper surfaces of the stage members 40*a*, 40*b*, respectively. The first clamping section 90 and the second clamping section 91 approach each other with the stage members 40*a*, 40*b* transitioning from an open state to a closed state. On the other hand, the first clamping section 90 and the second clamping section 91 are separated from each other with the stage members 40*a*, 40*b* transitioning from the closed state to the open state.

The first clamping section 90 is mounted on the one stage member 40*a*, and the second clamping section 91 is mounted on the other stage member 40*b*.

The first clamping section 90 is mounted on the upper surface of the stage member 40*a* by a fixing member such as a screw so as to facilitate mounting and detaching. The first clamping section 90 may be mounted on the upper surface of the stage member 40*a* by using a locking pawl or the like.

The first clamping section 90 is composed of a flat plate-like member such as a metal plate. The first clamping section 90 comprises a plurality of protrusions 90*a* that protrude toward the stage member 40*b* provided with the second clamping section 91. The plurality of protrusions 90*a* are each formed so as to have a width of, for example, about 20 mm in the vertical direction in FIG. 13, and are spaced apart from each other at a predetermined distance.

The second clamping section 91 is mounted on the upper surface of the stage member 40*b* by a fixing member such as a screw so as to facilitate mounting and detaching. The second clamping section 91 may be mounted on the upper surface of the stage member 40*b* by using a locking pawl or the like.

The second clamping section 91 is formed from a flat plate-like member such as a metal plate. The second clamping section 91 comprises a plurality of protrusions 91*a* that protrude toward spaces between the mutually adjacent protrusions 90*a* of the first clamping section 90. The plurality of protrusions 91*a* are each formed so as to have a width of, for example, about 20 mm in the vertical direction in FIG. 13, and are spaced apart from each other at a predetermined distance.

The protrusions 90*a* of the first clamping section 90 and the protrusions 91*a* of the second clamping section 91 overlap on each other on an upper portion of a gap between the stage members 40*a*, 40*b* in the state in which the stage members 40*a*, 40*b* are closed.

Herein, mutual overlapping is a condition in which ends in the first direction of the protrusions 90*a* are located on a side in the first direction with respect to ends in the second direction of the protrusions 91*a* in the state in which the stage members 40*a*, 40*b* are closed. However, the direction in which the protrusions 90*a* of the first clamping section 90 relatively approach the protrusions 91*a* of the second clamping section 91 is defined as the first direction, and the direction opposite to the first direction is defined as the second direction. Additionally, the state in which the stage members 40*a*, 40*b* are closed is a state in which the banknote storage bag 34 is clamped between the first clamping section 90 and the second clamping section 91.

As illustrated in FIG. 12A and FIG. 13, in the state in which the stage members 40*a*, 40*b* are closed, the protrusions 90*a* of the first clamping section 90 are disposed between the protrusions 91*a* adjacent to the second clamping section 91. Additionally, the protrusions 91*a* of the second clamping section 91 are disposed between the protrusions 90*a* adjacent to the first clamping section 90.

In the state in which the stage members 40*a*, 40*b* are closed, the ends on the right of the protrusions 90*a* in FIG. 13 are located on the right with respect to the ends on the left of the protrusions 91*a*, and the ends of the protrusions 91*a* are located on the left with respect to the ends of the protrusions 90*a*.

Consequently, the protrusions 90*a*, 90*b* regulate entering of a banknote between the stage members 40*a*, 40*b*.

As a result, even in a case in which banknotes are obliquely stored in the banknote storage bag 34, the first clamping section 90 and the second clamping section 91 can prevent the banknotes from falling in the gap formed between the stage members 40*a*, 40*b*.

Now, a method for determining a distance D1 between the mutually adjacent protrusions 90*a* of the first clamping section 90 will be described with reference to FIG. 15. A method for determining a distance between the mutually adjacent protrusions 91*a* of the second clamping section 91 is similar to this, and therefore description thereof will be omitted herein.

Figure 15:
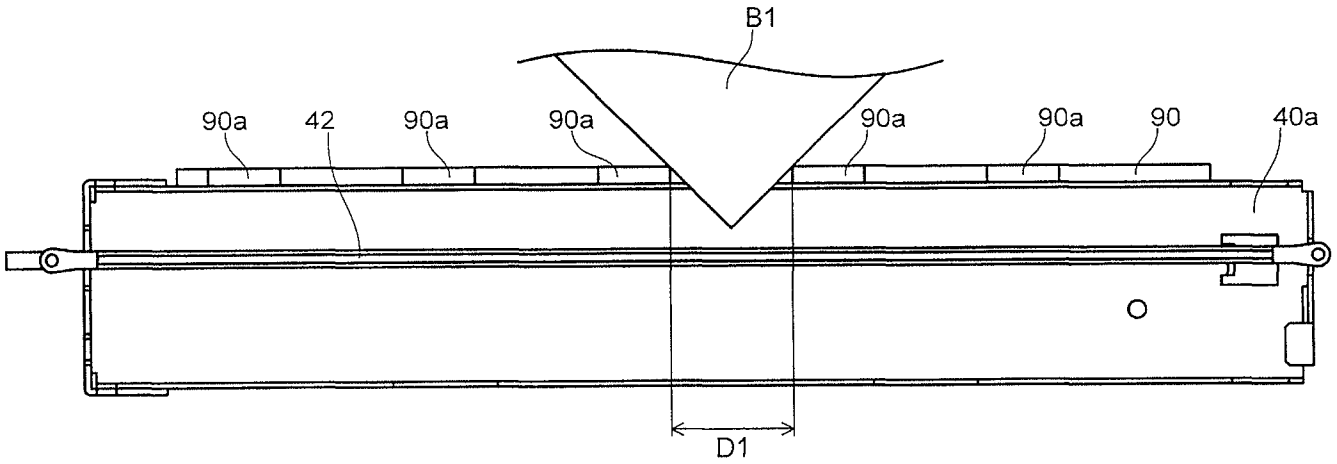
FIG. 15 is a sectional view taken along the line B-B of FIG. 13.

FIG. 15 is a sectional view taken along the line B-B of FIG. 13, and illustrates a state in which a corner of a single banknote B1 stored in the banknote storage bag 34 projects downward from a gap between the mutually adjacent protrusions 90*a*.

As described above, the stage members 40*a*, 40*b* have the respective second heating members 42, and the second heating members 42 heat-seal the banknote storage bag 34 in a mutually close contact state through the banknote storage bag 34.

Therefore, there is a possibility that when the banknote B1 projects downward from the gap between the mutually adjacent protrusions 90*a* to reach the second heating members 42, the banknote B1 is clamped in a portion to be heat-sealed in the banknote storage bag 34, and seal failure occurs. Accordingly, the distance D1 between the mutually adjacent protrusions 90*a* needs to set the corner so as not to reach the second heating members 42 even when the banknote B1 projects from the gap between these protrusions 90*a*.

When the banknote B1 projects downward from the space between the mutually adjacent protrusions 90*a*, and a shape of a projected portion is an isosceles triangle, distances between upper surfaces of the protrusions 90*a* and the corner of the banknote B1 is the longest compared to a case in which the shape is other triangle. In other words, a distance between the corner of the banknote B1 and the second heating members 42 is the shortest.

In this case, a distance between the corner of the banknote B1 that projects downward, and an upper surface of the first clamping section 90 is ½ of the distance D1 between the protrusions 90*a* disposed adjacent to each other (however, herein, assuming that the banknote B1 is in parallel to the crosswise direction of the banknote storage apparatus 10). Therefore, in order not to cause the corner of the banknote B1 projecting downward from the gap between the mutually adjacent protrusions 90*a* to reach the second heating members 42, the distance D1 between the mutually adjacent protrusions 90*a* needs to be shorter than twice the distance between the upper surface of the first clamping section 90 and the second heating members 42.

The distance D1 is thus determined, so that even in a case in which the banknote B1 projects below the first clamping section 90, the banknote B1 can be prevented from reaching the second heating members 42. As a result, the banknote B1 can be prevented from being clamped in a sealing portion of the banknote storage bag 34.

In a case in which the banknote B1 is bent, or in a case in which the banknote B1 is not in parallel to the crosswise direction of the banknote storage apparatus 10, there is a possibility that the banknote B1 projects further downward from the gap between the protrusions 90*a*. In consideration of such a case, the distance D1 may be set so as to provide a distance between the corner of the banknote B1 and each second heating member 42 with a margin.

For example, in a case in which distances between the upper surfaces of the protrusions 90*a* and the second heating members 42 are 20 mm, each distance D1 is preferably set to about 30 mm. In this case, even when the banknote B1 projects from the gap between the adjacent protrusions 90*a* in the state illustrated in FIG. 15, the corner of the banknote B1 can be separated from the second heating members 42 by about 5 mm.

The protrusions 90*a* are each formed in a substantially rectangular shape in plan view, round chamfering is provided on corners. Additionally, thread chamfering is provided on corners where the upper surfaces of the protrusions 90*a* intersect with side surfaces of the protrusions 90*a*, and corners where the side surfaces of the protrusions 90*a* intersect with lower surfaces of the protrusions 90*a*. Consequently, the banknote storage bag 34 clamped between the first clamping section 90 and the second clamping section 91 is prevented from being damaged.

Although the first clamping section 90 including the five protrusions 90*a* is illustrated in FIG. 12A to FIG. 13, the number of the protrusions 90*a* is not limited to this.

As illustrated in FIG. 14, in this embodiment, the protrusions 90*a* of the first clamping section 90 are located at higher positions than the protrusions 91*a* of the second clamping section 91. Consequently, gaps in the height direction between the protrusions 90*a* and the protrusions 91*a* are generated, and it is possible to reduce frictional force generated between the first clamping section 90 and the banknote storage bag 34 and between the second clamping section 91 and the banknote storage bag 34 when the stage members 40*a*, 40*b* move in the vertical direction.

The shapes of the protrusions 90*a* of the first clamping section 90, and the shapes of the protrusions 91*a* of the second clamping section 91 are not limited to the above forms, and any shapes may be employed as far as the protrusions 90*a* and the protrusions 91*a* overlap on each other. For example, at least one of the protrusions 90*a* and/or at least one of the protrusions 91*a* can comprise a semicircular shape. Further, although a case where the protrusions 90*a* and the protrusions 91*a* overlap on each other has been described, methods of solution to problem are not limited to this. For example, if the banknote storage bag 34 is gripped by the protrusions 90*a* and the protrusions 91*a* to bend and the protrusions 90*a* and the protrusions 91*a* does not overlap with each other, the first clamping section 90 and the second clamping section 91 can prevent the banknotes from falling in the gap formed between the stage members 40*a*, 40*b*.

Figure 16:
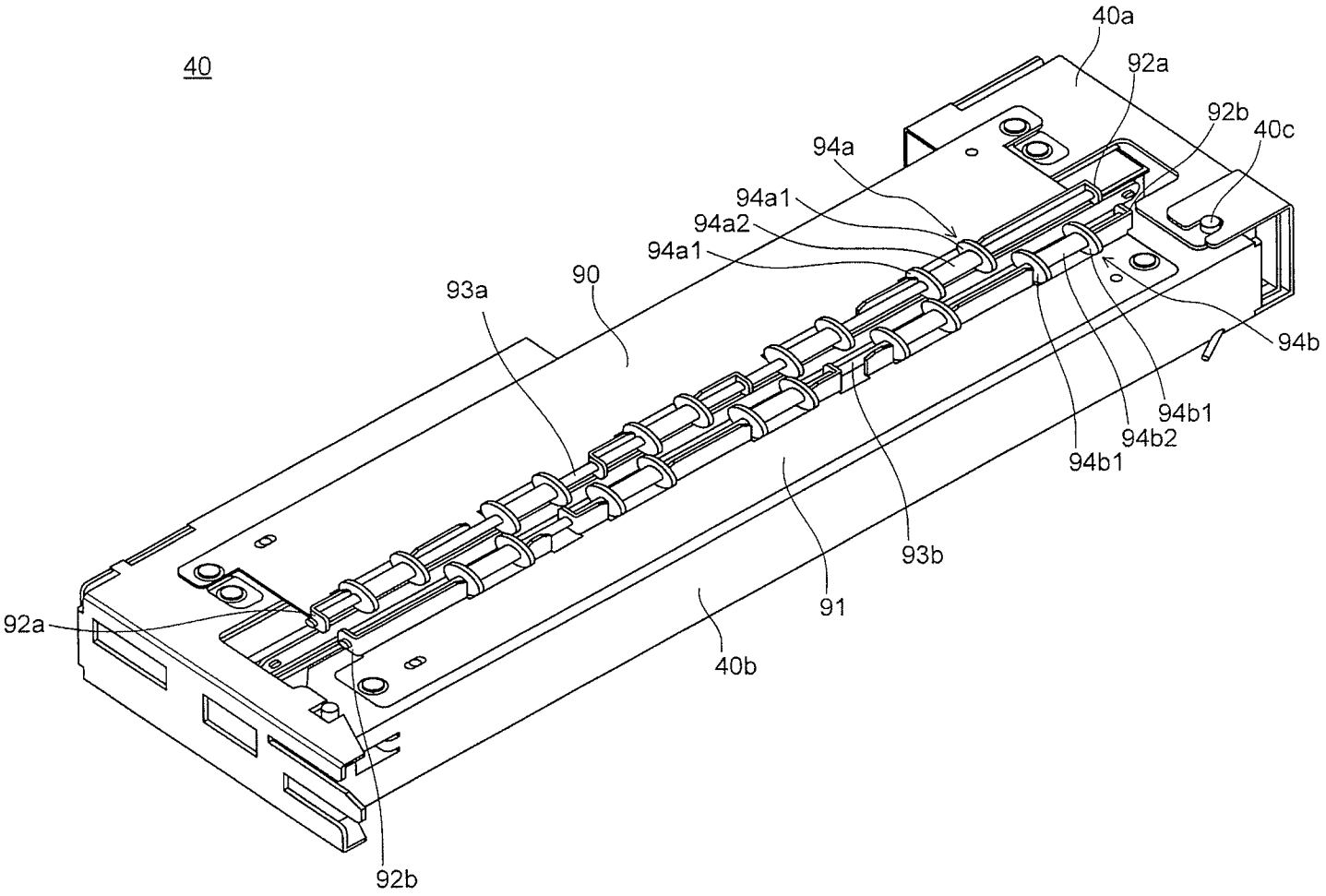
FIG. 16 is a perspective view of a pair of stages including a fall prevention structure of another form.

Now, another form of the fall prevention structure will be described. FIG. 16 is a perspective view of a pair of stages 40 including a fall prevention structure of another form, FIG. 17 is a plan view of the stages 40 including the fall prevention structure of another form, and FIG. 18 is a sectional view taken along the line C-C of FIG. 17.

A first clamping section 90 comprises flanges 92*a* that extend upward, a shaft member 93*a* supported by the flanges 92*a*, and rollers 94*a* pivotally supported by the shaft member 93*a* in the vicinity of a gap between a stage member 40*a* and a stage member 40*b*.

Figure 17:
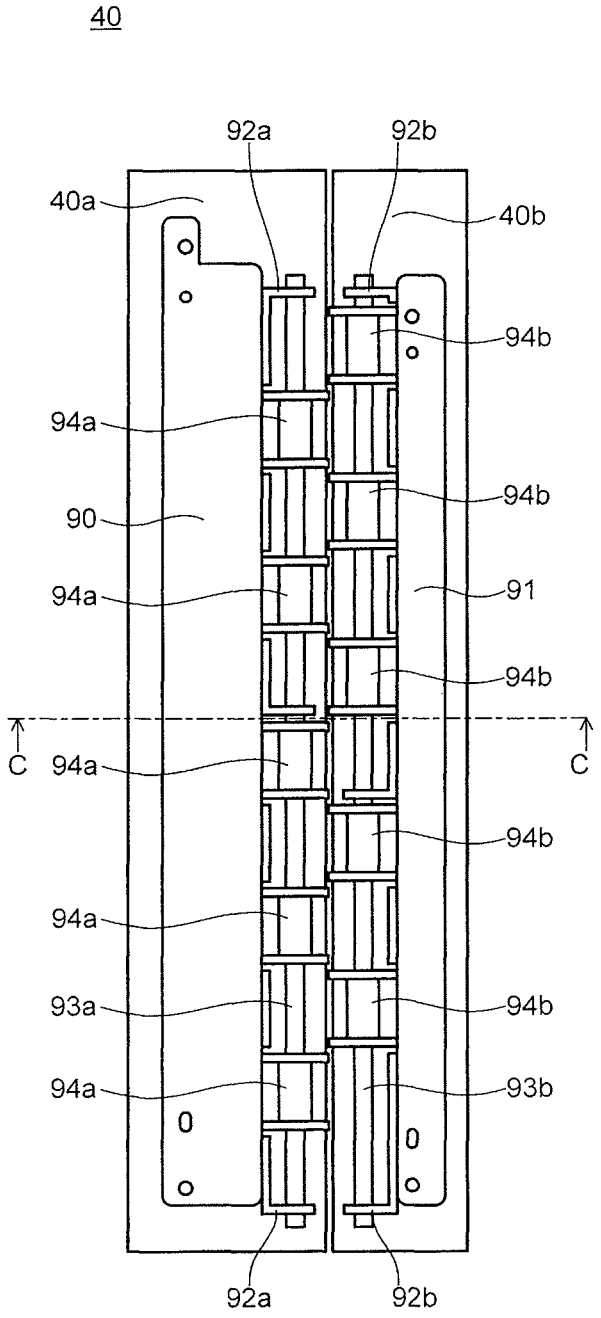
FIG. 17 is a plan view of the pair of stages including the fall prevention structure of another form.
Figure 18:
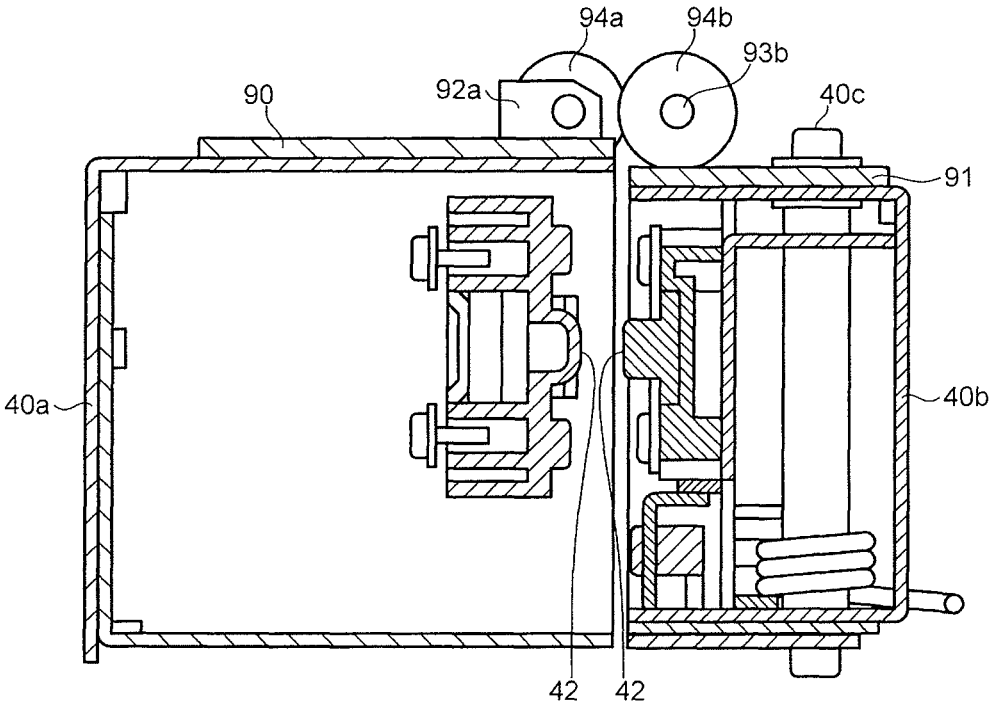
FIG. 18 is a sectional view taken along the line C-C of FIG. 17.

The flanges 92*a* are flat plate-like members, and are configured to be parallel to surfaces orthogonal to the vertical direction in FIG. 17, as illustrated in FIG. 17 and FIG. 18. The flanges 92*a* are each composed of, for example, a flat plate-like metal plate, or the like.

The flanges 92*a* each comprise a through hole that penetrates in the vertical direction in FIG. 17. The diameter of the through hole is formed to be larger than the diameter of the shaft member 93*a*.

The shaft member 93*a* is fitted into the through holes of the flanges 92*a* to be supported by the through holes. The shaft member 93*a* is a member that is fitted into through holes of the rollers 94*a*, and supports the rollers 94*a*.

The rollers 94*a* each are a member that abuts on the banknote storage bag 34 in a state in which the banknote storage bag 34 is clamped between the first clamping section 90 and the second clamping section 91.

Similarly to the protrusions 91*a* of the aforementioned embodiment, for example, the rollers 94*a* each have a width of about 20 mm, and are spaced apart from each other at a predetermined distance. The predetermined distance is formed to be larger than the width of each of rollers 94*b* described below. The predetermined distance is set to such a distance that the banknote B1 projecting downward from a gap between the adjacent rollers 94*a* does not reach second heating members 42.

The rollers 94*a* each comprise large-diameter sections 94*a*1 at both ends in the rotating shaft direction, and a small-diameter section 94*a*2 between the large-diameter sections 94*a*1 disposed at the both ends. In a state in which the stage members 40*a*, 40*b* are closed, the large-diameter sections 94*a*1 of the rollers 94*a* come into contact with the banknote storage bag 34. Consequently, contact areas between outer peripheral surfaces of the rollers 94*a* and the banknote storage bag 34 are reduced, and frictional resistance between the rollers 94*a* and the banknote storage bag 34 can be reduced.

A second clamping section 91 comprises flanges 92*b* that extend upward, a shaft member 93*b* supported by the flanges 92*b*, and the rollers 94*b* pivotally supported by the shaft member 93*b* in the vicinity of the gap between the stage member 40*a* and the stage member 40*b*. Configurations of the flanges 92*b*, the shaft member 93*b*, and the rollers 94*b* that the second clamping section 91 has are substantially similar to the configurations of the flanges 92*a*, the shaft member 93*a*, and the rollers 94*a* that the first clamping section 90 has, and therefore description thereof will be omitted herein.

The rollers 94*a* provided in the first clamping section 90, and the rollers 94*b* provided in the second clamping section 91 overlap on each other in an upper portion of the gap formed between the stage members 40*a*, 40*b*, in the state in which the stage members 40*a*, 40*b* are closed.

That is, in the state in which the stage members 40*a*, 40*b* are closed, ends on the right of the rollers 94*a* in FIG. 17 are located on the right with respect to ends on the left of the rollers 94*h*.

Consequently, the rollers 94*a*, 94*b* regulate entering of banknotes B1 into the gap between the stage members 40*a*, 40*b*.

As a result, the first clamping section 90 and the second clamping section 91 prevent the banknotes B1 stored in the banknote storage bag 34 from falling in the gap formed between the stage members 40*a*, 40*b*.

When the stage members 40*a*, 40*b* move in the vertical direction in a state in which the banknote storage bag 34 is clamped between the stage members 40*a*, 40*b*, the rollers 94*a*, 94*b* roll on a surface of the banknote storage bag 34. Consequently, it is possible to reduce frictional force generated between the banknote storage bag 34 and the first clamping section 90 and between the banknote storage bag 34 and the second clamping section 91.

Although the first clamping section 90 and the second clamping section 91 each including the five rollers are illustrated in FIG. 16 and FIG. 17, the numbers of the rollers 94*a*, 94*b* are not limited to this.

A flat plate-like protrusion may be provided in one of the first clamping section 90 and the second clamping section 91, and a protrusion composed of a roller may be provided in the other clamping section.

For example, as illustrated in FIG. 5, in a case in which the identifier 34*d* such as a bar code is printed on one surface of the banknote storage bag 34, a protrusion composed of a roller may be provided in a clamping section facing the surface on which the identifier 34*d* is printed, and a flat plate-like protrusion may be provided in a clamping section facing a surface on which the identifier 34*d* is not printed.

Consequently, it is possible to prevent the identifier 34*d* from being damaged due to rubbing of the flat plate-like protrusion and a portion printed with the identifier 34*d*, and suppress the cost compared to a case in which rollers are provided in the first clamping section 90 and the second clamping section 91.

The rollers 94*a*, 94*b* may be rotationally driven in conjunction with vertical motion of the stage members 40*a*, 40*b*. For example, when the stage members 40*a*, 40*b* move downward, the rollers 94*a*, 94*b* may rotate so as to send the banknote storage bag 34 upward, and when the stage members 40*a*, 40*b* move upward, the rollers 94*a*, 94*b* may rotate so as to send the banknote storage bag 34 downward. With such a configuration, it is possible to further reduce frictional resistance between the banknote storage bag 34 and the protrusion.

Figure 19:
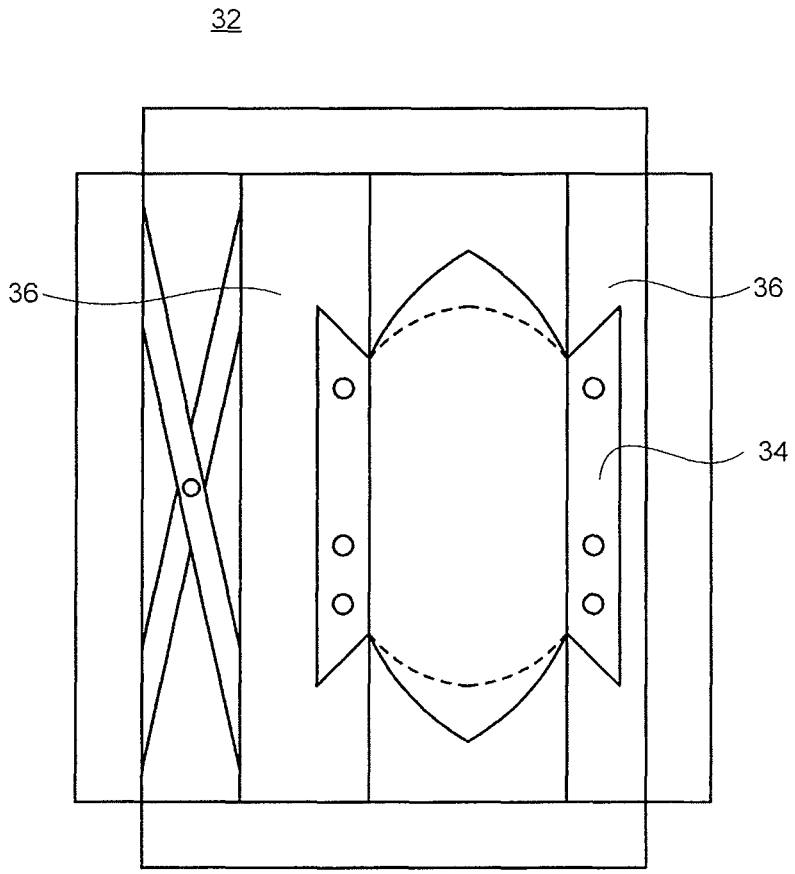
FIG. 19 is a plan view of holding members in a state in which the banknote storage bag is held.

Now, retry operation in a case in which the temporary storage sections 44 and the banknote storage bag 34 are caught when the temporary storage sections 44 rotate downward will be described with reference to FIG. 19. FIG. 19 is a plan view of holding members 36 in a state of holding the banknote storage bag 34.

As described above, in a portion in the vicinity of the opening of the banknote storage bag 34, a material having stronger stiffness than other portion is provided. Therefore, in a state in which the banknotes B1 are not stored in the banknote storage bag 34, the opening of the banknote storage bag 34 expands outward as illustrated in solid lines in FIG. 19.

However, when the banknote storage bag 34 is brought into a state close to a full state or a nearly full state, the opening of the banknote storage bag 34 is sometimes warped inward due to the weight of the banknotes B1, as illustrated by dotted lines of FIG. 19. In this case, as described above, there is a possibility that the temporary storage sections 44 that rotate downward are caught by the inner surface of the banknote storage bag 34, and the temporary storage sections 44 do not return upward.

In a case in which it is detected that the temporary storage sections 44 that rotate downward are caught by the inner surface of the banknote storage bag 34, and the temporary storage sections 44 do not return upward, the control section 80 performs the retry operation for returning the temporary storage sections 44 upward.

In the retry operation, the stepper motor 54 rotates such that the rotating shaft 66 rotates the second cam 71 in the direction opposite to the direction illustrated by the arrow illustrated in FIGS. 10A and 10B. When the rotating shaft 66 rotates, the second cam 71 provided in the rotating shaft 66 also rotates, and the second contactor 73*a* of the lock member 73 moves to the left in FIGS. 10A and 10B along the outer peripheral surface of the second cam 71. Consequently, the lock member 73 is brought into the lock release state.

Now, the control section 80 moves the one holding member 36 toward the other holding member 36. Consequently, the opening of the banknote storage bag 34 that is warped inward is warped outward, frictional force between the temporary storage sections 44 that rotates downward, and the inner surface of the banknote storage bag 34 is reduced, and catching of the temporary storage sections 44 and the inner surface of the banknote storage bag 34 is released. As a result, the temporary storage sections 44 rotate upward to be closed.

When the temporary storage sections 44 are closed, the stepper motor 54 rotates so as to rotate the second cam 71 in the arrow direction illustrated in FIGS. 10A and 10B. At this time, the second contactor 73*a* of the lock member 73 moves to the right in FIGS. 10A and 10B along the outer peripheral surface of the second cam 71. Consequently, the locking member 73*b* is caught by the protrusion of the lock plate 72*b*, so that the lock member 73 is brought into a lock state.

The one holding member 36 moved toward the other holding member 36 is moved up to an original position.

Such retry operation is performed, so that catching of the temporary storage sections 44 and the banknote storage bag 34 can be released, and the banknote sending-out section 48 can be brought into a state of capable of sending out the banknotes B1 toward the temporary storage sections 44 again.

It can be detected that the temporary storage sections 44 do not return upward by, for example, a photo interrupter having a light emission section and a light receiving section. Specifically, a flat plate-like detected plate is mounted on an end opposite to an end mounted with the gear 45 thereon in the shaft 44*a* of each temporary storage section 44. In a state in which the temporary storage sections 44 are closed, the photo interrupter is provided at such a position that light from the light emission section of the photo interrupter is blocked by the detected plates.

With such a configuration, it can be detected that the temporary storage sections 44 are not closed.

In the above retry operation, one holding member 36 moves toward the other holding member 36, and performs operation for returning to an original position again only once. However, this operation may be performed multiple times. Consequently, it is possible to reliably release catching of the temporary storage sections 44 and the banknote storage bag 34.

Before the temporary storage sections 44 are closed, the retry operation may be performed without fail.

Of course, a sheet to be stored in the sheet storage apparatus according to the present invention may not be the banknote B1, but may be a sheet such as a check and a coupon. That is, the sheet storage apparatus according to the present invention is not limited to the banknote storage apparatus, and may be an apparatus that stores a sheet other than the banknote B1.

INDUSTRIAL APPLICABILITY

The present invention is suitably utilized as a sheet storage apparatus.

REFERENCE SIGNS LIST

10 Banknote storage apparatus
12 Housing
14 Upper unit
16 Lower unit
20 Inlet section
20*a* Banknote feeding mechanism
22 Ejection section
22*a* Stacking wheel
22*b* Stacking wheel driving section
24 Transport unit
25 Diversion transport unit
26 Recognition unit
30 Storing/feeding unit
30*a* Drum
31 Tape
32 Banknote storage mechanism
34 Banknote storage bag
34*a* Protrusion
34*b* Hole
34*c* Reinforcing member
34*d* Identifier
36 Holding member
36*a* Pin
36*b* Surface
36*p* Guide pin
36*k* Frame body
36*q* Long hole
37 Slide mechanism
38 First heating member
39 One-side displacement lever
39*a* One-side displacement lever driving section
40 Stage
40*a* Stage member
40*b* Stage member
40*c* Hinge section
41 Stage driving section
42 Second heating member
44 Temporary storage section
44*a*, 46*c*, 51 Shaft
45, 55, 56, 57, 64 Gear
46 Press-in plate
46*a* Press-in portion
46*b* Base portion
46*d* Detected member
46*e* Mounting member
46*f* Guide hole
46*g* Pin member
47 Temporary storage amount detecting sensor
48 Banknote sending-out section
50 Pantograph
50*a*, 50*b*, 50*c*, 50*d*, 50*e*, 50*f* Link
52 Rack
54 Stepper motor
58, 62 Pulley
60 Circulating belt
66 Rotating shaft
70 First cam
71 Second cam
72 Power transmission member
72*a* Tooth portion
72*b* Lock plate
73 Lock member
73*a* Second contactor
73*b* Locking member
75 Detected plate
76 Upper-end detecting sensor
78 Lower-end detecting sensor
79 Stage position detecting sensor
79*a* First sensor
79*b* Second sensor
80 Control section
82 Operation display
84 Storage section
86 Printing section
88 Communication interface section
89 External apparatus
90 First clamping section
90*a*, 91*a* Protrusion
91 Second clamping section
92*a*, 92*b* Flange
93*a*, 93*b* Shaft member
94*a*, 94*b* Roller
94*a*1, 94*b*1 Large-diameter section
94*a*2, 94*b*2 Small-diameter section
B Banknote bundle
B1 Banknote

The invention claimed is:

1. A sheet storage apparatus, comprising:

a feeding section configured to feed a sheet from outside of the sheet storage apparatus into inside of the sheet storage apparatus, a holding section configured to hold an opening portion of a storage bag for storing the sheet fed into inside of the sheet storage apparatus by the feeding section;

first and second stages configured to be opened and closed, the first and second stages on which a bottom part of the storage bag held by the holding section is placed and between which the storage bag held by the holding section is capable of being disposed; and first and second clamping sections disposed on the first and second stages, respectively, and between which the storage bag held by the holding section is capable of being disposed, wherein the first clamping section is configured to and the second clamping section relatively approach the second clamping section in a first direction to clamp the storage bag held by the holding section, and an end of the first clamping section in the first direction is located on a side in the first direction with respect to an end of the second clamping section in a second direction opposite to the first direction in a state in which the first and second stages are closed.

2. The sheet storage apparatus according to claim 1, wherein the first clamping section comprises a plurality of first protrusions spaced apart from each other at a first distance and protruding in the first direction, and the second clamping section comprises a plurality of second protrusions spaced apart from each other at a second distance and protruding toward a space between the first protrusions adjacent to each other.

3. The sheet storage apparatus according to claim 2, further comprising a heater configured to heat and seal the storage bag held by the holding section on a lower side of the first clamping section and the second clamping section, wherein the first distance is at most twice a distance between an upper end of the first clamping section and the heater, and the second distance is at most twice a distance between an upper end of the second clamping section and the heater.

4. The sheet storage apparatus according to claim 1, wherein the first clamping section and the second clamping section are configured to approach each other, and be separated from each other by moving in a horizontal direction.

5. The sheet storage apparatus according to claim 1, wherein the first clamping section and the second clamping section are configured to move in a vertical direction along the storage bag held by the holding section, in a state in which the storage bag held by the holding section is clamped between the first clamping section and the second clamping section.

6. The sheet storage apparatus according to claim 1, wherein each of the first clamping section and the second clamping section is formed in a flat plate shape extending in a horizontal direction.

7. The sheet storage apparatus according to claim 1, wherein the first clamping section and or the second clamping section comprises first and second rollers, respectively, which abut the storage bag held by the holding section in a state in which the storage bag held by the holding section is clamped between the first and second clamping sections.

8. The sheet storage apparatus according to claim 7, wherein the storage bag comprises a side surface provided with a printed section, and each of the first clamping section and the second clamping section including the roller is disposed adjacent to the side surface of the storage bag.

9. The sheet storage apparatus according to claim 1, wherein the storage bag held by the holding section is clamped between the first clamping section and the second clamping section when the first and second stages are closed.

10. The sheet storage apparatus according to claim 1, wherein the first clamping section and the second clamping section are disposed on an upper surfaces of the first and second stages, respectively.

11. The sheet storage apparatus according to claim 1, wherein the first and second stages comprising heating members below the first and second clamping section respectively, the heating member configured to heat-seal the storage bag held by the holding section.

* * * * *